US007117991B2

(12) United States Patent
Waring

(10) Patent No.: US 7,117,991 B2
(45) Date of Patent: Oct. 10, 2006

(54) PORTABLE CARRIER

(75) Inventor: James Waring, Gurnee, IL (US)

(73) Assignee: Innovative Design Solutions, Inc., Libertyville, IL (US)

( * ) Notice: Subject to any disclaimer, the term of this patent is extended or adjusted under 35 U.S.C. 154(b) by 142 days.

(21) Appl. No.: 10/653,310

(22) Filed: Sep. 3, 2003

(65) Prior Publication Data

US 2005/0045640 A1 Mar. 3, 2005

(51) Int. Cl.
*B65D 25/24* (2006.01)

(52) U.S. Cl. ..... 206/45.2; 206/756; 206/227

(58) Field of Classification Search ..... 206/1.5, 206/216, 373, 541, 546, 548, 580, 769, 210, 206/45.2, 45.23, 756, 736, 389, 410, 361, 206/15.2, 227; 150/118, 159; 190/119–121; 70/68–70; 220/212
See application file for complete search history.

(56) References Cited

U.S. PATENT DOCUMENTS 2,094,186 A * 9/1937 Patrick ..... 206/315.4
2,099,805 A * 11/1937 Florman ..... 220/259.1
2,275,545 A 3/1942 Miller
2,718,251 A * 9/1955 Luca ..... 150/159
2,784,756 A * 3/1957 Resnick ..... 150/103
2,953,010 A * 9/1960 Behnke ..... 70/65
3,079,967 A 3/1963 Noel
3,314,194 A * 4/1967 Halleck ..... 47/69
3,412,888 A * 11/1968 Andrews et al. ..... 220/4.21
4,031,724 A * 6/1977 Atkinson ..... 70/68
4,350,274 A 9/1982 Morgan
4,595,226 A 6/1986 Wessel
4,613,041 A 9/1986 Carlton
4,685,559 A 8/1987 Titus
4,968,048 A 11/1990 Lortie
5,035,321 A * 7/1991 Denton ..... 206/225
D326,347 S 5/1992 Ancona
5,207,321 A 5/1993 Jones
5,839,771 A 11/1998 DeMars
5,904,247 A * 5/1999 Voelkner, Jr. ..... 206/315.4
5,941,381 A 8/1999 James
6,161,692 A * 12/2000 Lizarraga ..... 206/315.3
6,237,796 B1 5/2001 Murphy
6,460,697 B1 10/2002 Stevens
6,851,285 B1 * 2/2005 Haas ..... 70/26

* cited by examiner

*Primary Examiner*—David T. Fidei
*Assistant Examiner*—Jerrold Johnson
(74) *Attorney, Agent, or Firm*—Berenato, White & Stavish LLC

(57) ABSTRACT

A portable carrier includes a base housing and a cover member secured to the base housing. The base housing is provided with an internal cavity defined by a bottom wall and an enclosing wall extending substantially upwardly from the bottom wall. The cover member is adapted for selectively reconfiguring the portable carrier between a first, closed position preventing access to the internal cavity and a second, open position providing access to the internal cavity. The cover member is dimensioned to closely conform an outer peripheral surface of the base housing so that in the second position the cover member is nested under the base housing over and around the outer peripheral surface thereof. The portable carrier further includes a child-resistant locking device provided for preventing the portable carrier from being open.

42 Claims, 34 Drawing Sheets

PORTABLE CARRIER

BACKGROUND OF THE INVENTION

1. Field of the Invention

The present invention relates to portable carriers and methods related thereto. More particularly the present invention relates to a portable carrier having a rigid base housing and a cover member, dimensioned to closely conform to an outer peripheral surface of the base that can be used for storing and transporting liquid or chemical supplies safely and conveniently.

2. Description of the Prior Art

As is well known, cleaning supplies such as detergents, upholstery cleaners, glass cleaners, paper towels, and the like are commonly used in domestic and institutional cleaning operations, as well as other settings such as the cleaning of cars, trucks, boats, and recreational vehicles. It is quite common for households and businesses to purchase and store a large number of all types of liquids or powdered household chemical cleansers. Various commercial chemical products are used to clean surfaces, mirrors, countertops, toilet bowls, urinals, furniture, appliances, and other structures. In most cases, the consumer will simply store these products in places which are readily accessible to small children, such as unlocked cabinets, counters and the like. Liquids or powdered chemical cleaners pose a potentially serious poison hazard to an unwary child who cannot comprehend the potential danger in ingesting these harmful products.

It is necessary to carry the cleaning supplies around the building, house or to the vehicle to be cleaned. This is particularly true in institutional or commercial cleaning operations. Cleaning supplies are commonly carried in a piecemeal fashion around a building, house or from a common storage location, such as a storage closet or beneath a kitchen sink. This typically involves several trips and is a considerable inconvenience to the user of the cleaning supplies. Also, it is often the case that the cleaning supplies are not stored within a common location, thereby necessitating that the user locate individual cleaning supplies prior to carrying the cleaning supplies to the appliance or room to be cleaned. In addition, paper towels must be located and carried separately during the cleaning operation. Therefore, merely obtaining the necessary supplies can be a time-consuming and bothersome task. Thus, it would be desirable to provide a single device for transporting and storing cleaning chemical products and other cleaning supplies, such as paper towels.

The prior art portable caddies are useful to some degree for their stated purposes and include means for transporting various cleaning supplies. However, although the prior art has recognized to a limited extent the problems of transporting and storing cleaning supplies, the proposed solutions have to date been ineffective in providing a satisfactory remedy, especially making the harmful cleaning chemicals inaccessible to children.

SUMMARY OF THE INVENTION

The present invention provides a novel portable carrier for storing potentially hazardous supplies such as harmful cleaning chemicals, that is inaccessible to small children and sturdy and compact enough to be easily carried throughout a house or building to where the supplies are needed. The portable carrier of the present invention further serves for transporting and storing cleaning chemical products and other cleaning supplies, such as a roll of paper towels, rubber gloves and the like, which are transported along with the chemical cleansers, and keeping them out of reach of small children. The present invention may further serve for transporting and storing first-aid supplies, pharmaceuticals or craft supplies, such as paint, glue, glitter, pins and the like and keeping them out of reach of small children.

The portable carrier in accordance with the present invention, comprises a rigid base housing defining an internal cavity formed by a bottom wall and an enclosing wall extending substantially upwardly from the bottom wall, a handle secured to the base housing and provided for carrying the portable carrier by hand, and a cover member attached to the base housing to cover the internal cavity. The cover member is adapted for selectively reconfiguring the portable carrier between a first, closed position preventing access to the internal cavity and a second, open position providing access to the internal cavity. The cover member is dimensioned to closely conform an outer peripheral surface of the base housing so that in the second position the cover member is nested under the base housing over around the outer peripheral surface thereof. The portable carrier of the present invention further includes a locking device provided for preventing the cover member from being freely opened. Preferably, the locking device is a child-resistant lock.

The portable carrier of the present invention can also include at least one reversible window formed in the cover member for allowing visual access into contents of the internal cavity of the carrier. Preferably, the window is formed of a sheet of a transparent plastic material covering an opening cut in the cover member. Alternatively, the window may be arranged in the form of a transparent pocket for inserting a card for displaying a name of the user and/or listing the content of the portable carrier.

The portable carrier in accordance with a first exemplary embodiment of the present invention, comprises the rigid base housing having a substantially rectangular cross-section, and a reversible flexible cover member attached to the base housing to cover the internal cavity so that the handle extends from the flexible cover member through an opening therein. The flexible cover member has at least one closure member being selectively openable for providing an access to the internal cavity and closeable for forming an enclosed compartment and preventing the access to the internal cavity. Thus, the closure member of the reversible flexible cover member allows for selectively reconfiguring the portable carrier between a first, closed position preventing access to the internal cavity, and a second, open position providing access to the internal cavity.

The reversible flexible cover member in accordance with the present invention is dimensioned to closely conform to the base housing so that in the second, open position, the flexible cover member is reversed and folded over and around an outer peripheral surface of the rigid base housing for nesting under the base housing.

The reversible flexible cover member is attached to the rigid base housing adjacent to a top edge thereof. Preferably, the closure member is a conventional zipper extending substantially parallel to the top edge of the rigid base housing around the majority of the circumference of the top edge.

In operation, in order to reconfigure the portable carrier from the first, closed position to the second, open position, a finger tab of the zipper is pulled by a user to open the closure member. When the zipper is fully open, the flexible cover member is reversed and folded over and around the outer peripheral surface of the rigid base housing. Once in this position, the reversible zipper is reclosed, thus allowing the flexible cover member to be nested under the base housing.

Preferably, the flexible cover member is provided with side pockets that are attached to the inside of the cover member so that when the carrier is in the open position the pockets are accessible.

Furthermore, the portable carrier may include a paper towel dispensing device provided in the flexible cover member. Preferably, the paper towel dispensing device includes a circular plate constructed of rubber or a similar material, having a plurality of flexible legs that allow paper towels to be dispensed while the portable carrier is in the closed position.

The handle member includes a support portion extending substantially upwardly from the bottom wall of the rigid base housing, and a handle portion integrally formed at a distal end of the support portion. Preferably, the support portion is formed integrally with the bottom wall of the base housing from the same material and partitions the internal cavity into two elongated compartments adapted to contain bottles with cleaning chemicals. The internal cavity further includes a substantially cylindrical compartment serving to receive a roll of paper towels which are routinely used in cleaning operations, and smaller compartments disposed about the cylindrical compartment and adapted to contain cleaning rags or other small objects.

A grip handle of the handle portion is positioned offset from a center line of the base housing in the direction of the longer side wall in order to balance the carrier as the chemicals in the compartments are heavier than the paper towel roll in the cylindrical compartment and rugs in the smaller compartments.

A second exemplary embodiment of the present invention discloses a portable carrier having a flexible cover member that includes two substantially parallel closure members each having a reversible zipper. The zippers are operated by sliders that are coupled to a single pulling tab for pulling the sliders simultaneously to open or close the zippers. The pulling tab is provided with a locking key formed integrally therewith and a handle. The pulling tab is shaped to clear the handle portion of the carrier while opening or closing the zippers.

The portable carrier of the second exemplary embodiment further includes a child-resistant lock provided with an opening adapted to receive and engage the locking key of the pulling tab, thus locking the portable carrier in a closed position.

Similarly to the portable carrier of the first exemplary embodiment of the present invention, the flexible cover member of the portable carrier of the second exemplary embodiment is dimensioned to closely conform an outer peripheral surface of the base housing so that in the second, open position, the flexible cover member is nested under the base housing.

A third exemplary embodiment of the present invention discloses a portable carrier comprising a substantially rigid base housing defining an internal cavity, a handle member secured to the rigid base housing, a flexible cover member, and cable locking mechanism adapted to secure the flexible cover member to the base housing in both open and closed positions. The cable locking mechanism includes a flexible cable coupled to a lock so as to form a closed loop.

The lock is adapted to adjust a circumference of the closed loop by increasing or reducing its length. The cable is threaded through a tubular lower edge portion of the flexible cover member. Thus, by rotating a locking dial of the lock the user can tighten the cable to lock the flexible cover member in place or loosen the cable to free the flexible cover member so that it can be removed. Preferably, the lock has a child-resistant construction, meaning that it is necessary to first push or squeeze then rotate the locking dial in order to tighten or loosen the cable.

A fourth exemplary embodiment of the present invention discloses a portable carrier comprising a substantially rigid base housing defining an internal cavity, a handle member secured to the rigid base housing and partitioning the internal cavity into two elongated compartments, the flexible cover member, the child-resistant locking device, and two auxiliary insert trays removably supported within the elongated compartments in the internal cavity.

A fifth exemplary embodiment of the present invention discloses a portable carrier comprising a substantially rigid base housing defining an internal cavity, a handle member secured to the rigid base housing and partitioning the internal cavity into two elongated compartments, the flexible cover member, and a child-resistant locking device including a safety cap adapted to threaded to a cylindrical threaded to protrusion of a lock support member formed integrally with the base housing. Preferably, the safety cap is in the form of a security screw cap well known and widely used in many commercial products such as medicine bottles, for preventing young children from having access to the contents of receptacles when these include dangerous products such as medicaments. The portable carrier of the fifth exemplary embodiment of the present invention is further provided with a flexible cord attached directly to the safety cap at one end and to the finger tab of the zipper slider at the other end thereof.

A sixth exemplary embodiment of the present invention discloses a portable carrier comprising a rigid base housing having has a substantially cylindrical, bucket shape defining an internal cavity, and a flexible cover member attached to the rigid base housing. Both the rigid base housing and the flexible cover member of the portable carrier of the sixth exemplary embodiment of the present invention include a handle made of a substantially flexible material. The flexible cover member includes a substantially cylindrical side wall and a selectively openable closure member covering the open top of the rigid base housing. The closure member is operated by a drawstring attached to a safety cap of a child-resistant locking device at a distal end thereof.

A seventh exemplary embodiment of the present invention discloses a portable carrier comprising a substantially rigid base housing defining an internal cavity, a handle member secured to the rigid base housing, a substantially rigid cover member removably secured to the base housing, and a locking device.

Preferably, the locking device is in the form of a child-resistant lock comprising a lock support member in the form of a substantially cylindrical threaded protrusion formed integrally with the base housing, and a safety cap. The safety cap is secured to the rigid cover member through a cord. Alternatively, the locking device includes a padlock preventing a locking dial from rotating.

The portable carrier of the seventh exemplary embodiment of the present invention is selectively reconfigured between a first, closed position preventing access to the internal cavity when the rigid cover member closes an open top of the base housing, and a second, open position providing access to the internal cavity to allow items to be placed or removed therefrom when the rigid cover member is removed from the top edge of the rigid base housing. Moreover, the rigid cover member of the portable carrier is dimensioned to closely conform an outer peripheral surface of the base housing so that in the second, open position, the rigid cover member is nested under the base housing.

Therefore, the portable carrier in accordance with the present invention provides for transporting and storing cleaning chemical products and other cleaning supplies conveniently, safely and out of reach of unauthorized persons, such as children.

BRIEF DESCRIPTION OF THE DRAWINGS

Other objects and advantages of the invention will become apparent from a study of the following specification when viewed in light of the accompanying drawings, wherein:

FIG. 30 is a perspective view of the portable carrier in accordance with the sixth exemplary embodiment of the present invention in a second, open position with the safety cap on;

DETAILED DESCRIPTION OF PREFERRED EMBODIMENTS

Figure 1:
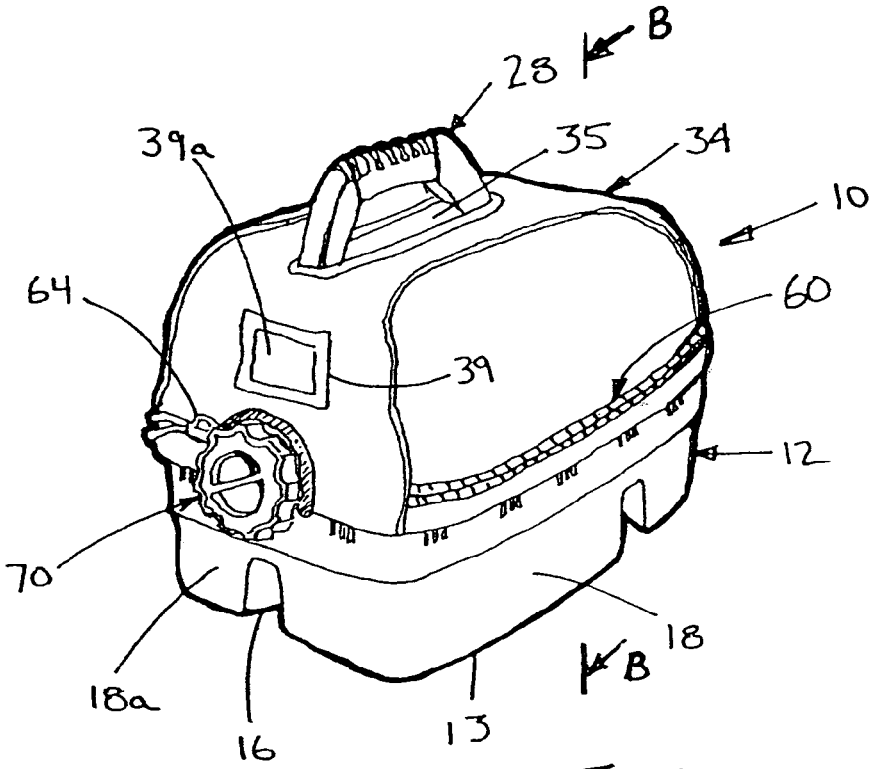
FIG. 1 is a perspective view of a portable carrier in accordance with a first exemplary embodiment of the present invention in a first, closed position.

The preferred embodiments of the present invention will now be described with the reference to accompanying drawings.

FIGS. 1–8 of the drawings illustrate a first exemplary embodiment of a portable carrier generally indicated at 10, in accordance with the present invention. The carrier 10 effectively transports and stores cleaning chemical products and other cleaning supplies, such as chemical cleansers, a roll of paper towels, rubber gloves and the like and a structure that also can selectively keep them out of the reach of small children. The carrier 10 may further serve for transporting and storing first-aid supplies, pharmaceuticals or craft supplies, such as paint, glue, glitter, pins and the like and keeping them out of reach of small children.

The portable carrier 10 features a substantially rigid base housing 12 defining an internal cavity 14, a handle member 24 secured to the rigid base housing 12 and provided for carrying the portable carrier 10 by hand, and a reversible flexible cover member 34 secured to the rigid base housing 12 to cover the internal cavity 14 so that the handle member 24 extends from the flexible cover member 34 through an opening 35 therein. The internal cavity 14 of the rigid base housing 12 is adapted to accommodate one or more containers chemical cleaners or other necessary products, and is defined by a bottom wall 16 and an enclosing wall 18 that extends substantially upwardly from the bottom wall 16. Moreover, the housing 12 has an open top defined by a top edge 20 of the enclosing wall 18. Preferably, the housing 12 is made of a substantially rigid material that also resists spills of chemical cleaners such as plastic.

Figure 4:
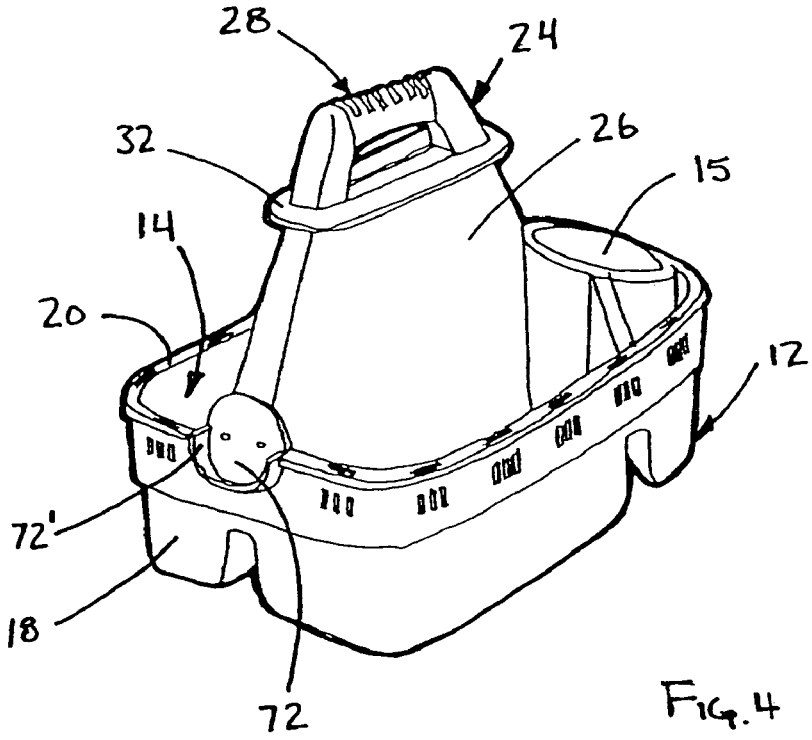
FIG. 4 is a perspective view of the portable carrier with a flexible cover member removed in accordance with the first exemplary embodiment of the present invention.
Figure 5:
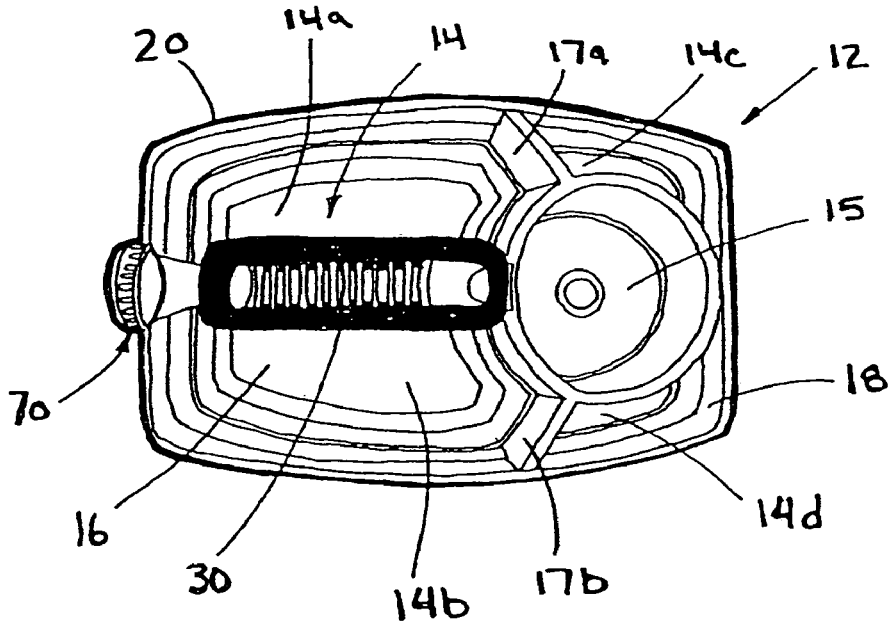
FIG. 5 is a top view of the portable carrier with a flexible cover member removed in accordance with the first exemplary embodiment of the present invention.

As illustrated in FIGS. 4 and 5, the base housing 12 is preferably substantially rectangular in cross-section. However, it will be appreciated that alternatively, the base housing 12 may have any appropriate cross-section, such as circular, oval, square, pentagonal, hexagonal, etc.

The handle member 24 includes a support 26 extending substantially upwardly from the bottom wall 16 of the rigid base housing 12, and a handle portion 28 integrally formed at a distal end of the support 26. Preferably, as illustrated in FIGS. 4 and 5, the support 26 is formed integrally with the bottom wall 16 of the base housing 12 from the same material and partitions the internal cavity 14 into two elongated storage compartments 14*a* and 14*b*.

Figure 6:
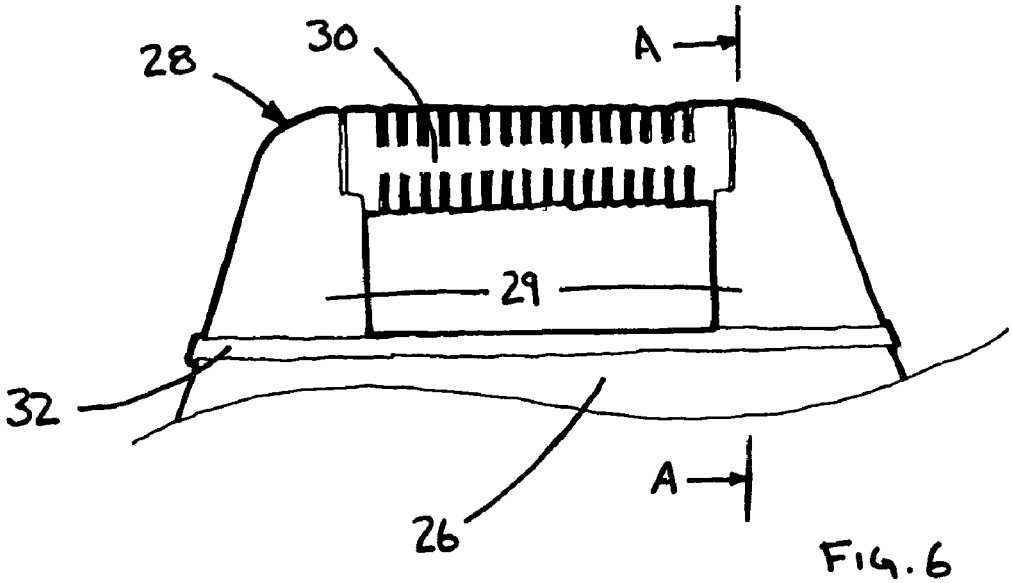
FIG. 6 is a partial side view of a handle member of the portable carrier in accordance with the first exemplary embodiment of the present invention.
Figure 7:
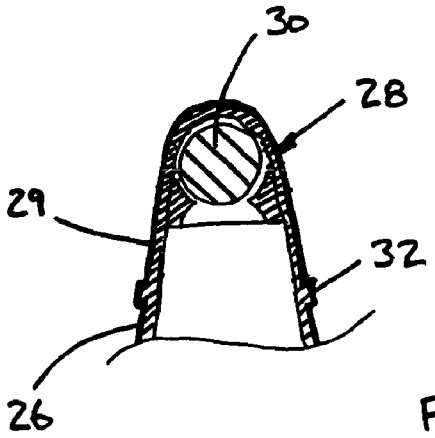
FIG. 7 is a cross-sectional view taken along line A—A of FIG. 6.

As further illustrated in detail in FIGS. 6 and 7, the handle portion 28 includes two opposite legs 29 adapted to rotatably support a grip 30, thus allowing the portable carrier 10 to remain oriented substantially vertically with the bottom 13 of the housing 12 substantially parallel to the ground while transported around by a user regardless of the angle of the users hand or wrist with respect to the handle portion 28. As shown in FIG. 7, in this embodiment the grip 30 is snap-fit into the legs 29. Preferably, the legs 29 of the handle portion 28 are formed integrally with the support 26 from the same material, while the grip 30 is formed separately from the same or different type material such as plastic. The grip 30 may be colored similarly or differently from the rest of the handle member 24 or the base housing 12, and may be covered with a partially deformable grip sleeve.

As described above, the handle member 24 extends from the flexible cover member 34 through an opening 35 therein. More specifically, as illustrated in FIG. 1, only the handle portion 28 of the handle member 24 extends from the flexible cover member 34. Thus, in order to support a portion of the flexible cover member 34 around the opening 35, the handle member 24 further includes an integral cover support flange 32 substantially horizontally extending between the support 26 and the handle portion 28, as shown in FIG. 4.

Figure 3:
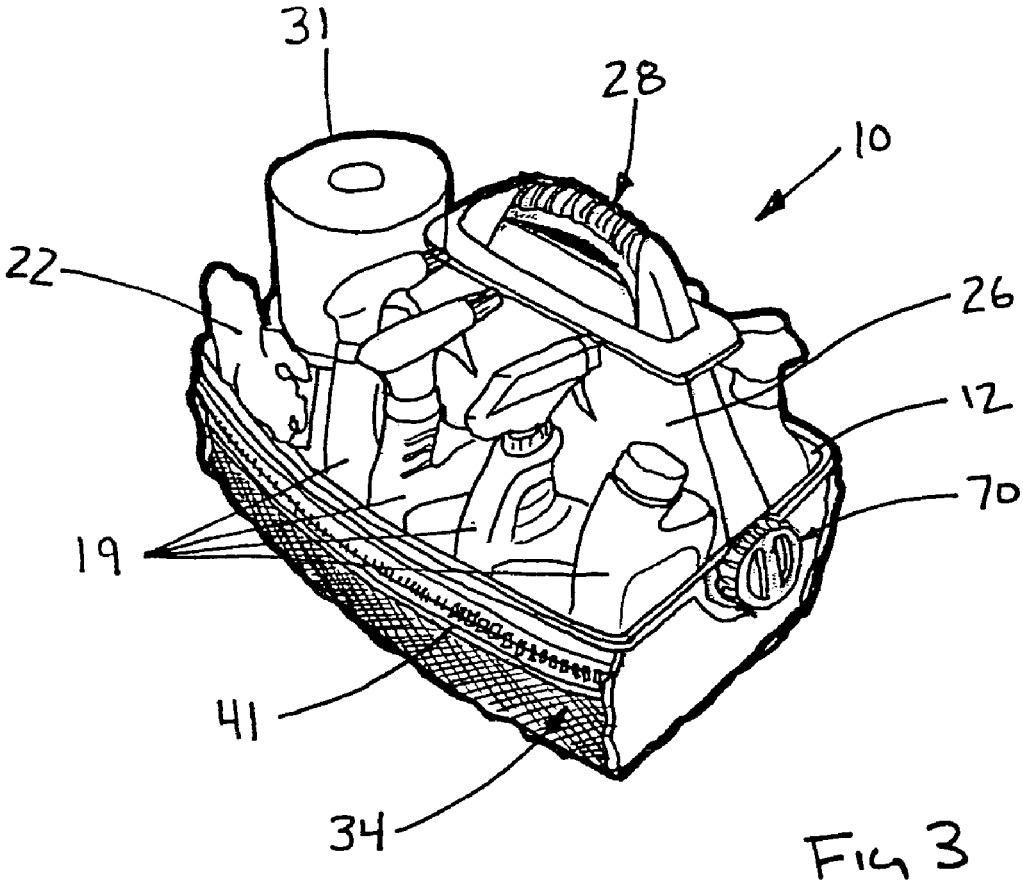
FIG. 3 is a perspective view of the portable carrier in accordance with the first exemplary embodiment of the present invention in an open position containing bottles with cleaning chemicals, a roll of paper towels and cleaning rag.

As further shown in FIGS. 4 and 5, the internal cavity 14 includes a substantially cylindrical compartment 15 that can receive and partially support a roll 31 of paper towels which are routinely used in cleaning operations, as illustrated in FIG. 3. The storage compartments 14*a* and 14*b* may be adapted to contain bottles 19 with cleaning chemicals. As further illustrated in FIG. 5, the internal cavity 14 also includes partition walls 17*a* and 17*b* separating the storage compartments 14*a* and 14*b* from smaller storage compartments 14*c* and 14*d* disposed about the cylindrical compartment 15. The storage compartments 14*c* and 14*d* may be adapted to contain cleaning rags 22 or other small objects, as illustrated in FIG. 3. The compartments 14*a*, 14*b*, 14*c* and 14*d* are preferably molded into the base housing, although one or more of them could be constructed to be removable.

The chemicals in the storage compartments 14*a* and 14*b* can often be heavier than the paper towel roll in the compartment 15 and rags or other items in the storage compartments 14*c* and 14*d*. In order to compensate for this the grip 30 can be positioned offset from the center line of the base housing 12 such as shown in FIG. 5.

In accordance with first exemplary embodiment of the present invention, the flexible cover member 34 is secured to the enclosing wall 18 of the rigid base housing 12 adjacent to the top edge 20 thereof. The present invention envisions a variety of arrangements for securing the flexible cover member 34 to the enclosing wall 18.

Figure 10A:
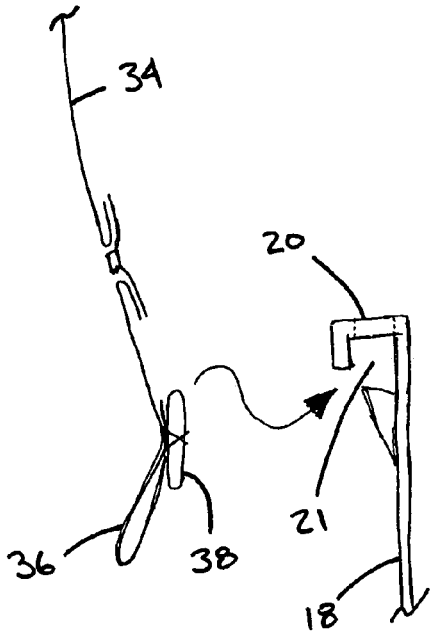
FIG. 10A is a partial exploded view of the portable carrier showing a first exemplary embodiments of securing the flexible cover member to a rigid base housing.
Figure 10B:
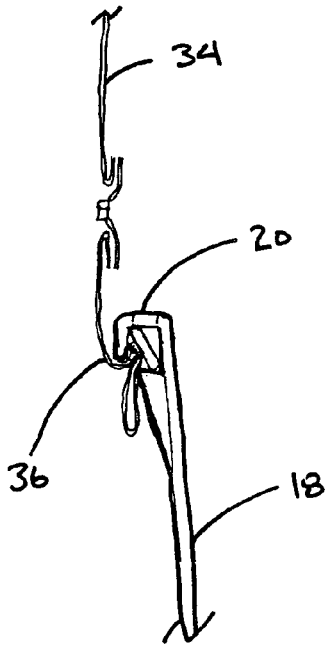
FIG. 10B is partial cross-sectional view of the portable carrier taken along line B—B in FIG. 1 showing the first exemplary embodiments of securing the flexible cover member to a rigid base housing.

In the embodiment illustrated in FIGS. 10A and 10B, a polypropylene (or the like material) strapping 38 is sewn to an inside surface of a lower edge portion 36 of the flexible cover member 34. The strapping 38 is then pushed into a mounting channel 21 formed in the enclosing wall 18 adjacent to the top edge 20 thereof and snapped into a locked position.

Figure 11:
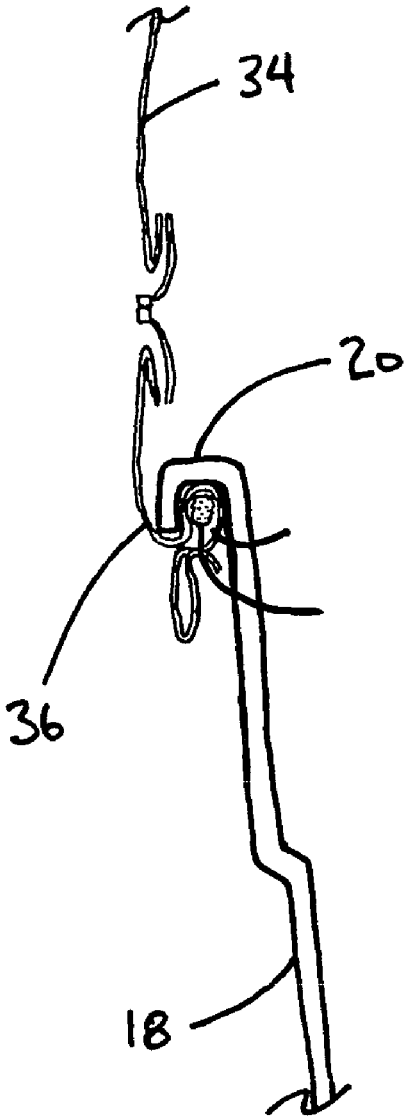
FIG. 11 is partial cross-sectional view of the portable carrier taken along line B—B in FIG. 1 showing a second exemplary embodiment of securing the flexible cover member to a rigid base housing.

In the embodiment illustrated in FIG. 11, a drawstring 40 is used in order to secure the lower edge portion 36 of the flexible cover member 34 in the mounting channel 21 in the enclosing wall 18 adjacent to the top edge 20 thereof.

Figure 12:
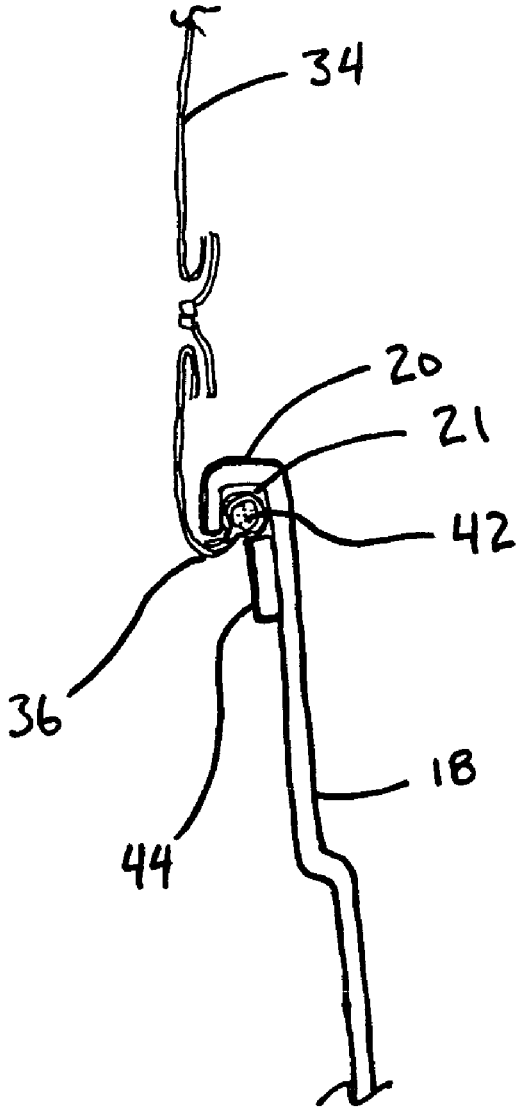
FIG. 12 is partial cross-sectional view of the portable carrier taken along line B—B in FIG. 1 showing a third exemplary embodiment of securing the flexible cover member to a rigid base housing.

In the embodiment illustrated in FIG. 12, the lower edge portion 36 of the flexible cover member 34 reinforced with a core 42 is inserted into the mounting channel 21 in the enclosing wall 18 and secured therein by a retention ring 44 adhesively fixed to the enclosing wall 18 of the base housing 12.

Figure 13:
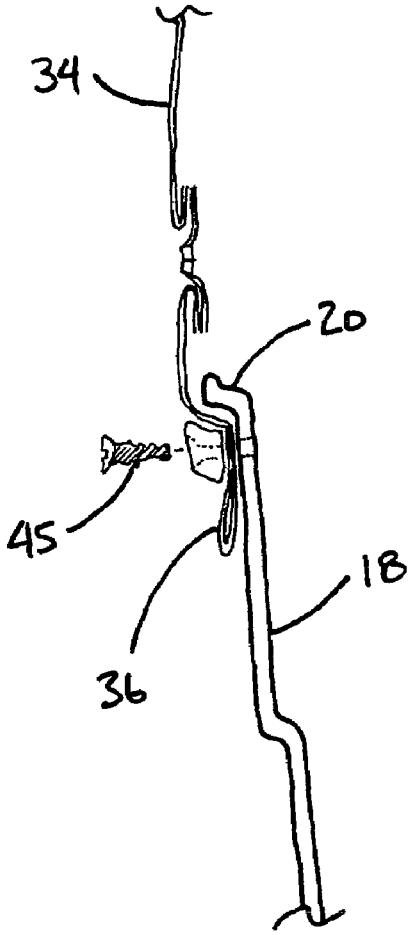
FIG. 13 is partial cross-sectional view of the portable carrier taken along line B—B in FIG. 1 showing a fourth exemplary embodiment of securing the flexible cover member to a rigid base housing.

In the embodiment illustrated in FIG. 13, the lower edge portion 36 of the flexible cover member 34 is secured to the base housing 12 through a plurality of screws 45 (only one is shown) threaded into the enclosing wall 18 adjacent to the top edge 20 thereof.

Figure 14:
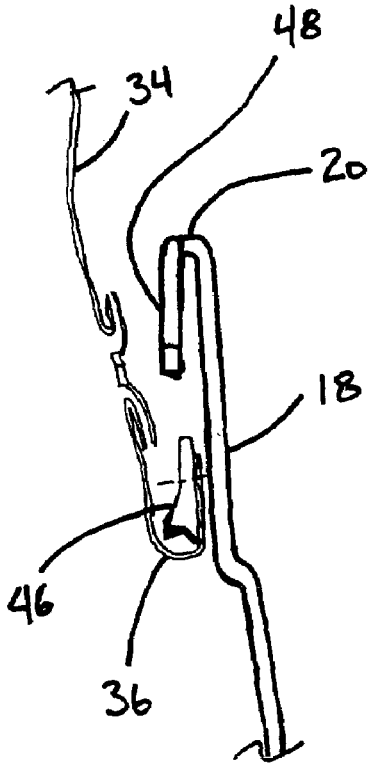
FIG. 14 is partial cross-sectional view of the portable carrier taken along line B—B in FIG. 1 showing a fifth exemplary embodiment of securing the flexible cover member to a rigid base housing.

In the embodiment illustrated in FIG. 14, a key lock snap 46 is sewn, adhesively bonded or otherwise secured to the lower edge portion 36 of the flexible cover member 34. At the same time, the top edge 20 of the enclosing wall 18 is provided with a locking flange 48. The key lock snap 46 engages the locking flange 48 of the enclosing wall 18 and snaps into a locked position.

Figure 15:
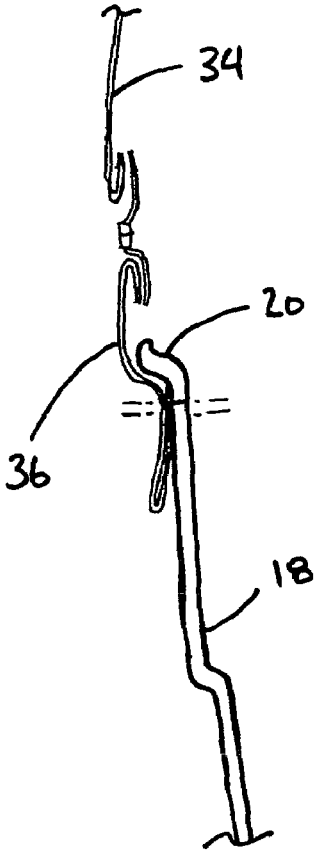
FIG. 15 is partial cross-sectional view of the portable carrier taken along line B—B in FIG. 1 showing a sixth exemplary embodiment of securing the flexible cover member to a rigid base housing.

In the embodiment illustrated in FIG. 15, the lower edge portion 36 of the flexible cover member 34 is sewn or adhesively bonded to the enclosing wall 18 of the base housing 12 adjacent to the top edge 20 thereof.

Figure 16:
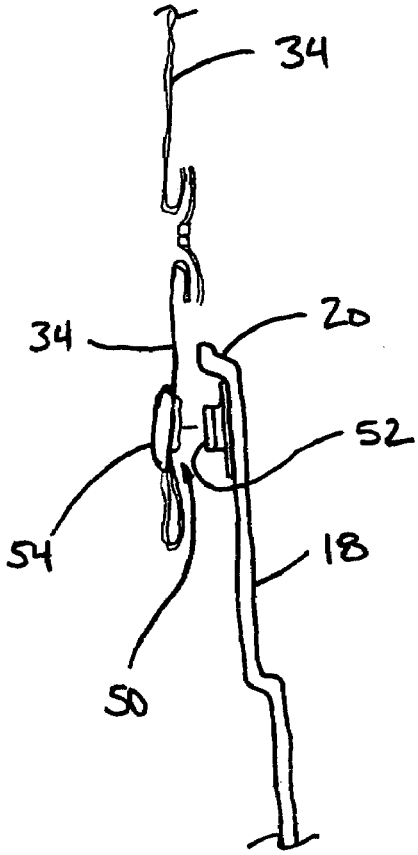
FIG. 16 is partial cross-sectional view of the portable carrier taken along line B—B in FIG. 1 showing a seventh exemplary embodiment of securing the flexible cover member to a rigid base housing.

In the embodiment illustrated in FIG. 16, the flexible cover member 34 is secured to the base housing 12 through a plurality of detachable fasteners 50 (only one is shown) each including a male member 52 fixed to the enclosing wall 18 adjacent to the top edge 20 thereof, and a female member 54 is secured to the lower edge portion 36 of the flexible cover member 34.

Figure 17:
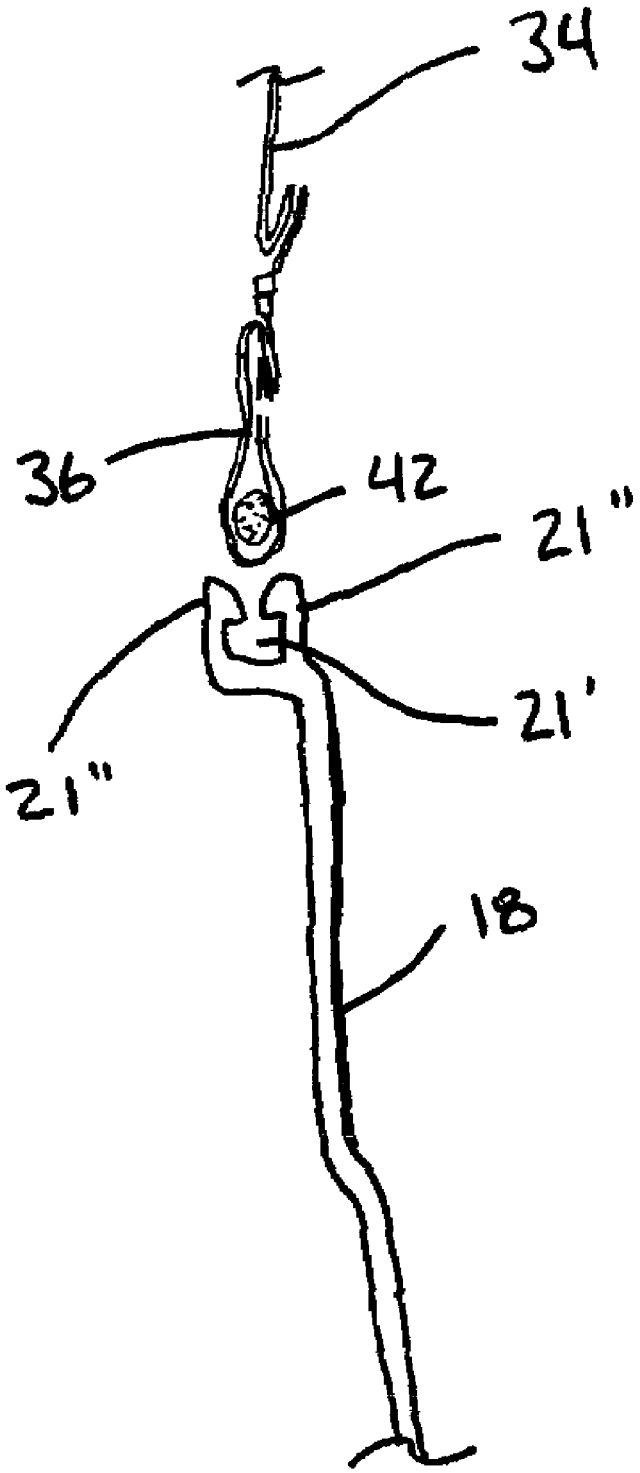
FIG. 17 is partial cross-sectional view of the portable carrier taken along line B—B in FIG. 1 showing an eighth exemplary embodiment of securing the flexible cover member to a rigid base housing.

In the embodiment illustrated in FIG. 17, a grip channel 21' is formed in the enclosing wall 18 adjacent to the top edge 20 thereof. The grip channel 21' has a pair of gripping legs 21". The lower edge portion 36 of the flexible cover member 34 reinforced with the core 42 is inserted into the grip channel 21 and snap fitted therein by the gripping legs 21".

Figure 18:
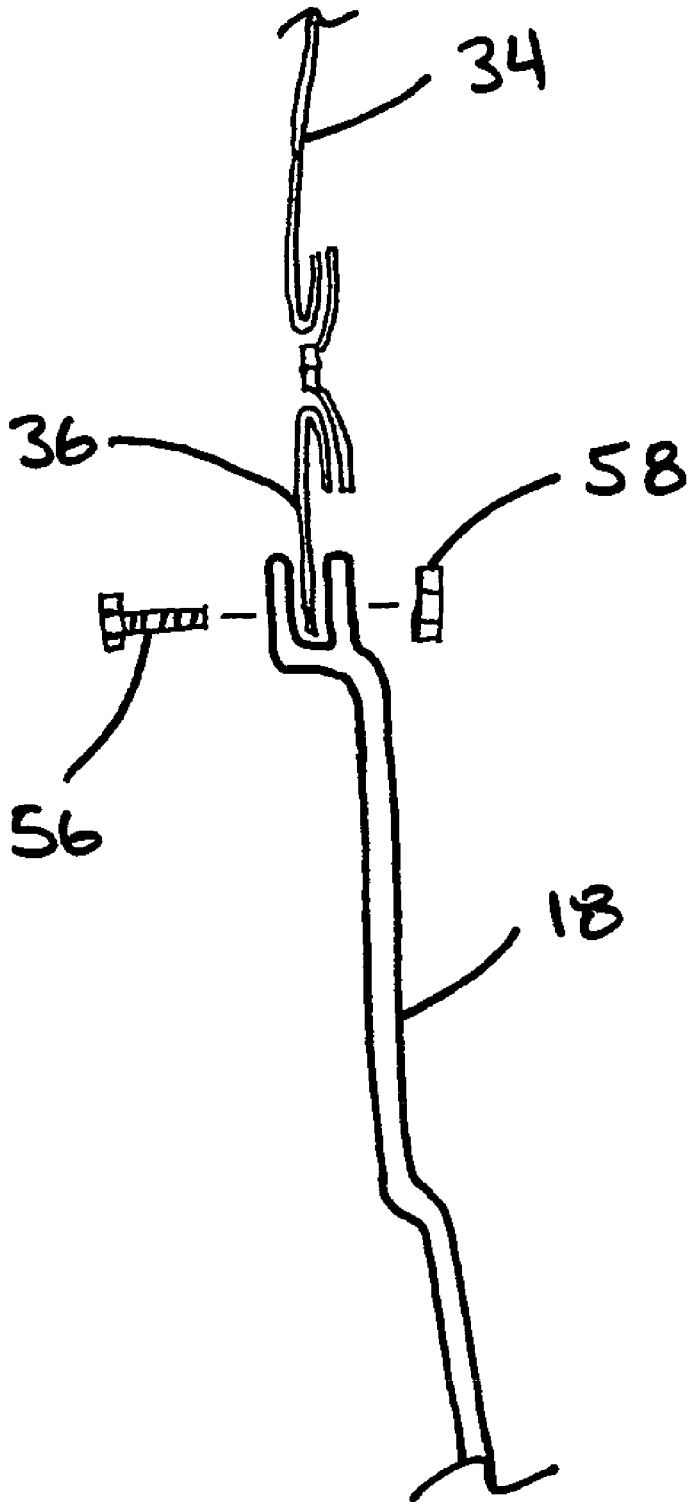
FIG. 18 is partial cross-sectional view of the portable carrier taken along line B—B in FIG. 1 showing a ninth exemplary embodiment of securing the flexible cover member to a rigid base housing.

In the embodiment illustrated in FIG. 18, the lower edge portion 36 of the flexible cover member 34 is secured to the base housing 12 through a plurality of threaded fasteners, such as bolts 56 and nuts 58 (only one pair is shown).

It will be appreciated by those skilled in the art that any other appropriate arrangements of securing the flexible cover member 32 to the enclosing wall 18, such as pinning or riveting, are within the scope of the present invention.

Figure 8:
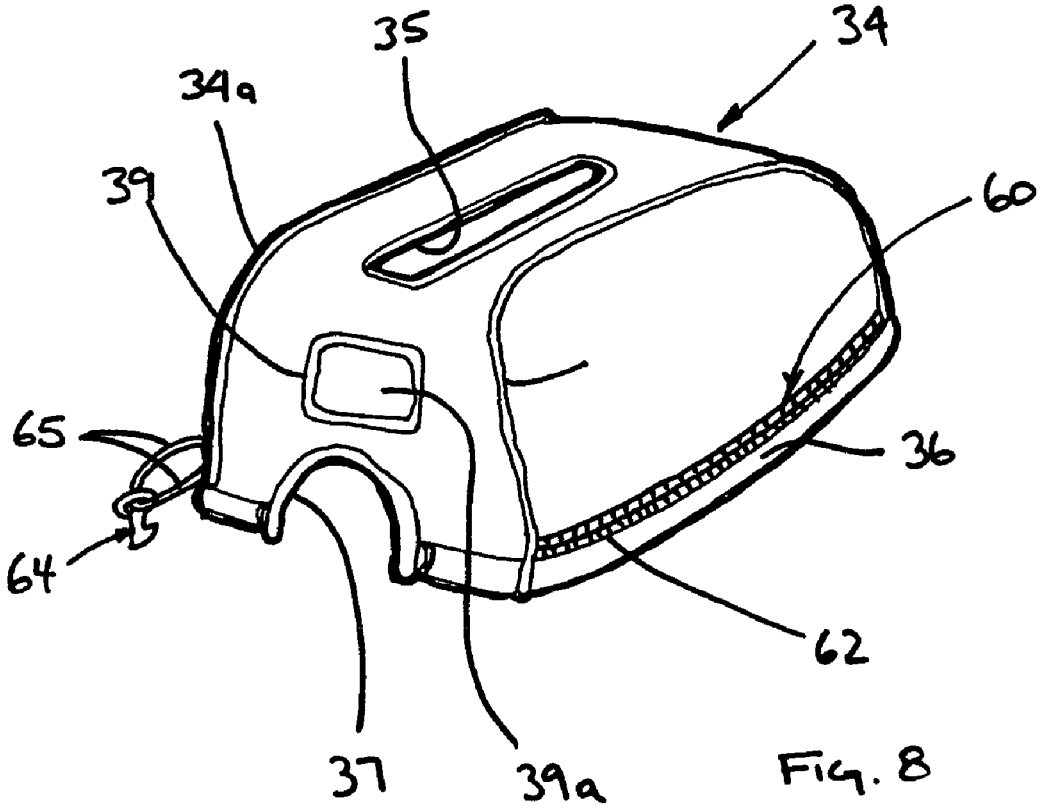
FIG. 8 is a perspective view of the flexible cover member of the portable carrier in accordance with the first exemplary embodiment of the present invention.

As further illustrated in FIGS. 1 and 8, the flexible cover member 34 is provided with a selectively openable closure member 60, preferably in the form of a reversible zipper 62. It will be appreciated by those skilled in the art that any other appropriate closure members, such as VELCRO, snap fasteners, etc., are within the scope of the present invention. The zipper 62 allows the portable carrier 10 to be selectively reconfigured between a first, closed position, illustrated in FIG. 1, for preventing access to the internal cavity 14 when the zipper 62 is closed, and a second, open position, illustrated in FIG. 2, providing access to the internal cavity 14 to allow items to be placed or removed therefrom when the zipper 62 is fully open. The zipper 62 is operated by a conventional slider (not shown) and a finger tab (not shown) coupled thereto for pulling the slider to open or close the zipper 62, as is well known to those skilled in the art. Moreover, the flexible cover member 34 is provided with a locking key 64 coupled to the finger tab through a flexible cord 65.

In accordance with the first exemplary embodiment of the present invention, as illustrated in FIGS. 1, 2, 4 and 8, the zipper 62 preferably extends substantially parallel to the top edge 20 of the rigid base housing 12 along approximately three quarters of the circumference of the top edge 20.

Figure 2:
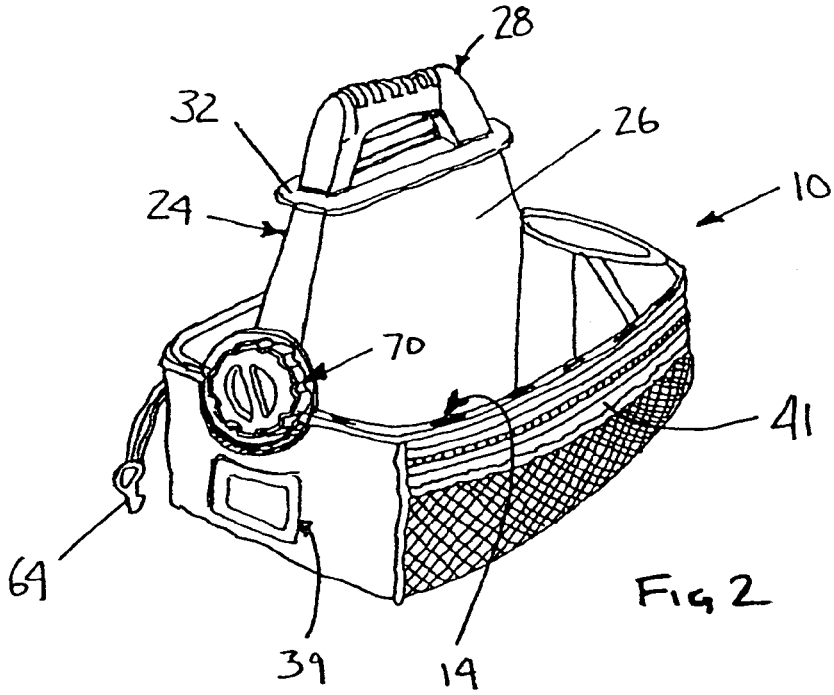
FIG. 2 is a perspective view of the portable carrier in accordance with the first exemplary embodiment of the present invention in a second, open position.

Moreover, the flexible cover member in accordance with the present invention is dimensioned to closely conform to an outer peripheral surface of the base housing 12 so that in the second, open position, the flexible cover member 34 is nested under the base housing 12, as shown in FIG. 2.

Figure 1A:
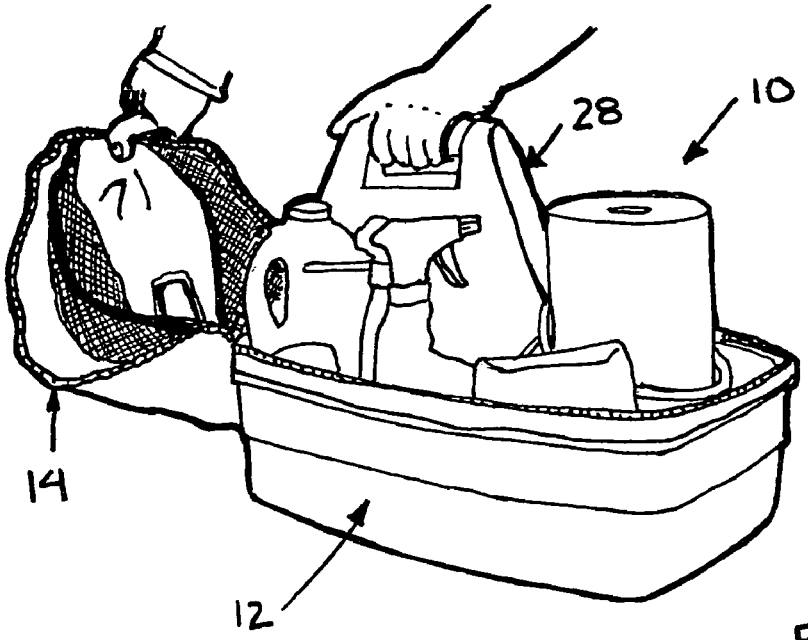
FIG. 1A is a perspective view of the portable carrier in accordance with the first exemplary embodiment of the present invention in a partially open position.
Figure 1B:
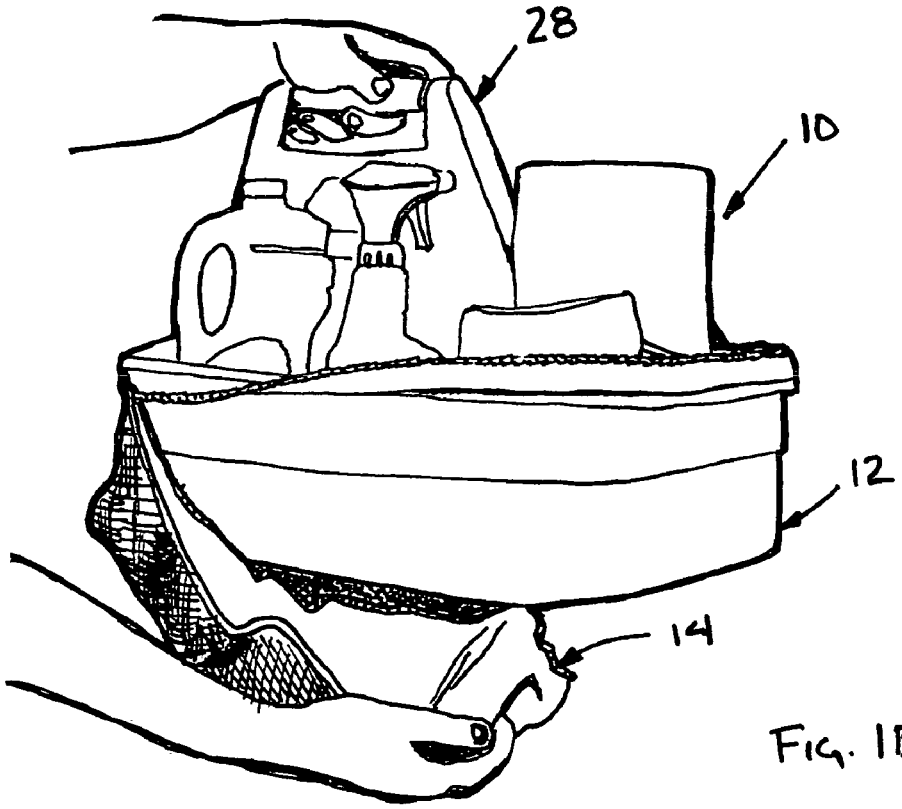
FIG. 1B is a perspective view of the portable carrier in accordance with the first exemplary embodiment of the present invention with a flexible cover reversed and folded over a rigid base housing.

In operation, in order to reconfigure the portable carrier 10 from the first, closed position to the second, open position, the finger tab of the zipper 62 pulled by the user to open the closure member 60. When the zipper 62 is fully open, the flexible cover member 34 is reversed and folded over and around the outer peripheral surface of the rigid base housing 12 as illustrated in stages in FIGS. 1A, 1B and 2. In this position, the reversible zipper 62 is reclosed, thus allowing the flexible cover member 34 to be nested under the base housing 12, as shown in FIG. 2.

Figure 9:
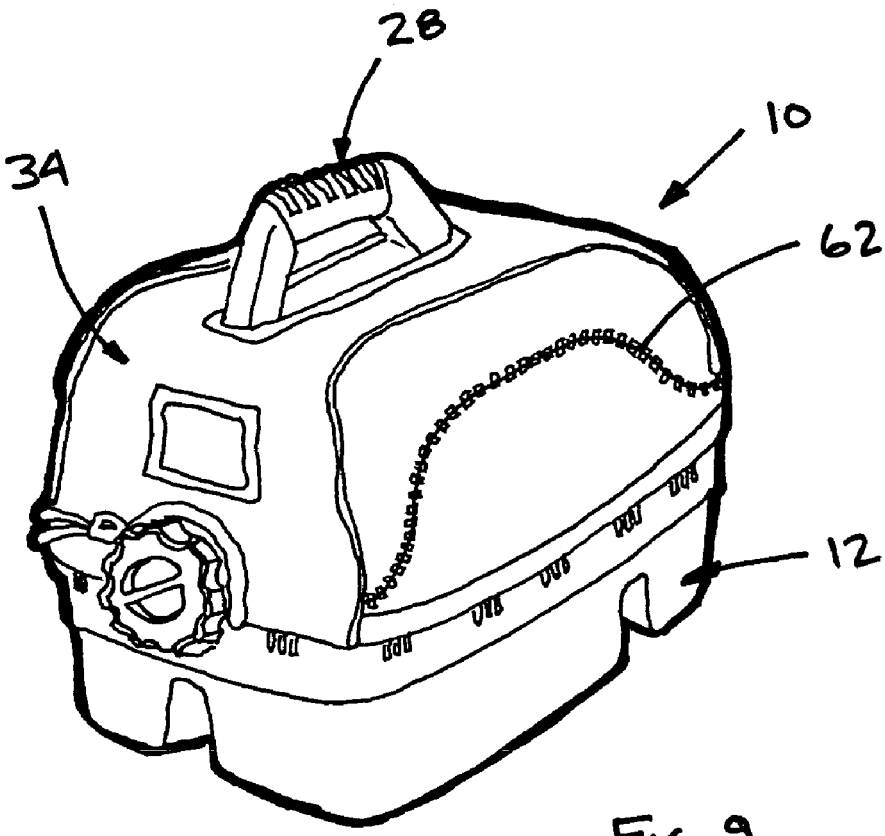
FIG. 9 is a perspective view of the portable carrier in accordance with the first exemplary embodiment of the present invention in a closed position having an alternative configuration of a reversible zipper of a closure member.

It will be appreciated by those skilled in the art that alternative configurations of the zipper 62 are possible, such as one illustrated in FIG. 9 that may make it easier to reverse the flexible cover member 34 from the closed position to the open position and vice versa.

Preferably, the flexible cover member 34 is constructed of a water-resistant material that also is resistant to the chemical cleaning compositions and relatively tear resistant such as plastic or the like. Moreover, a surface of the flexible cover member 34 can also be provided with a layer (not shown) of vapor repellant or vapor absorbing material adapted to keep spills or vapors of the cleaning chemicals from soaking through the flexible cover member 34. The layer of vapor repellant or vapor absorbing material is provided on the inside of the flexible cover member 34 when the portable carrier is in the first, closed position.

In order to keep the shape of the flexible cover member 34 in its closed position, the flexible cover member 34 is provided with reinforcing rods 34*a* shown in FIG. 8. Preferably, the reinforcing rods 34*a* are made of elastic or semi-rigid material and are secured to the flexible cover member 34 by any appropriate means well known in the art.

Figure 19:
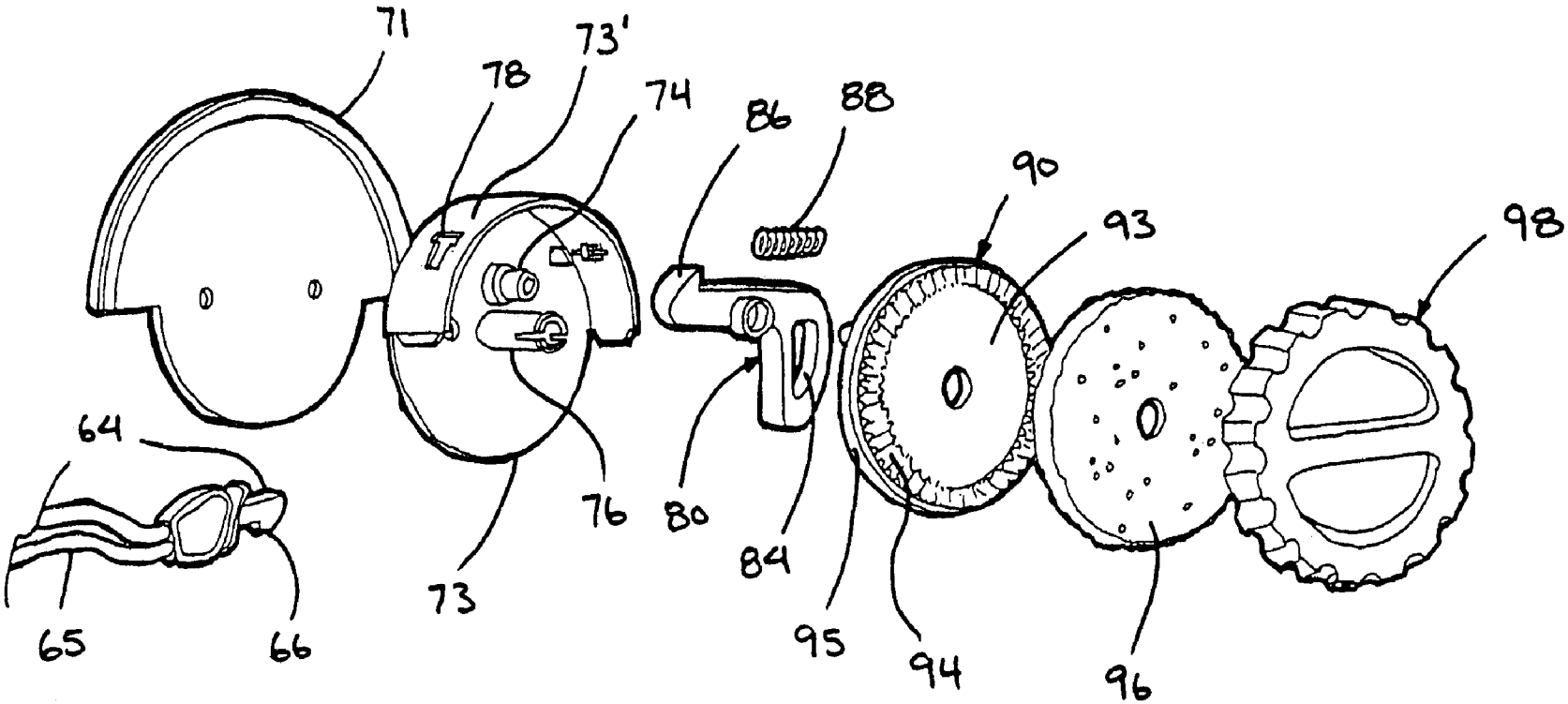
FIG. 19 is an exploded perspective view of a child-resistant lock in accordance with the first exemplary embodiment of the present invention.

The portable carrier 10 in accordance with the present invention is further provided with a keyless child-resistant locking device 70 adapted to prevent small children from accessing the objects, such as harmful cleaning chemicals, stored in the internal cavity 14 of the carrier 10. The child-resistant locking device 70, illustrated in detail in FIG. 19, features a lower lock housing 72 formed integrally with the enclosing wall 18 of the base housing 12 (shown in FIG. 4), an upper lock housing 73 attached to the lower lock housing 72, a locking latch member 80 pivotally mounted on a pivot pin 74 fixed to the upper lock housing 73, an actuator plate 90 rotatably supported on a central shaft 76 fixed to the upper lock housing 73, and a locking dial 98 also rotatably supported on the central shaft 76 of the upper lock housing 73. Preferably, the child-resistant locking device 70 also includes a vapor barrier 71 adapted to prevent spills and vapors of the harmful cleaning chemicals from the escaping the portable carrier 10 when the flexible cover member 34 is in the first, closed position. The vapor barrier 71 is sandwiched between the upper lock housing 73 and the lower lock housing 72 of the locking device 70. The locking latch member 80 has a latching tooth 86 adapted to engage a locking tooth 66 of the locking key 64, and an actuator groove 84 adapted to engage therein an actuator pin 92 formed on the actuator plate 90. A circular outer surface 93 of the actuator plate 90 is provided with a plurality of teeth 94 facing the locking dial 98. In turn, a circular inner surface of the locking dial 98 is provided with a plurality of teeth (not shown) facing the teeth 94 of the circular outer surface 93 of the actuator plate 90.

Preferably, the teeth 94 of the actuator plate 90 are generally complementary to the teeth of the locking dial 98. The locking dial 98 is axially movable along the central shaft 76 of the upper lock housing 73 between a first position when the teeth of the locking dial 98 are axially spaced from the teeth 94 of the actuator plate 90, and a second position when the teeth of the locking dial 98 positively engage the teeth 94 of the actuator plate 90 by axially inwardly pushing the locking dial 98. In the particular exemplary embodiment illustrated in FIG. 19, the locking device 70 is provided with an elastic buffer plate 96 disposed between the actuator plate 90 and the locking dial 98. Preferably, the elastic buffer plate 96 is an annular foam plate.

Figure 20:
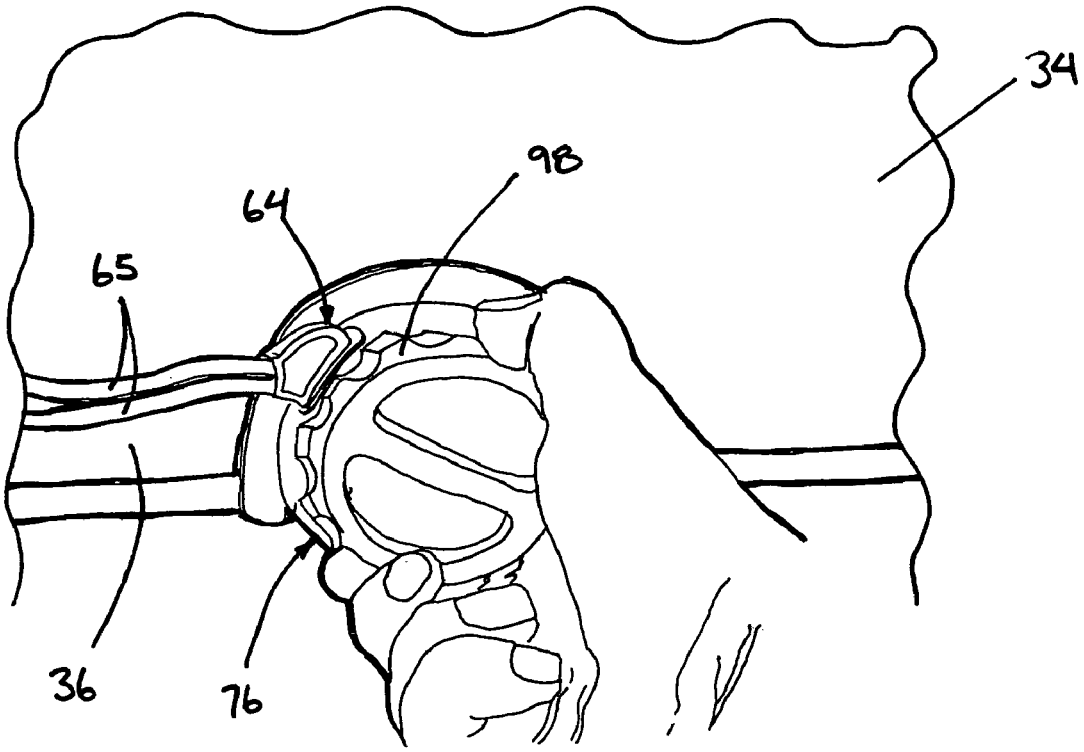
FIG. 20 shows operation of a locking dial where a user either pushes and turns or squeezes and turns the locking dial.

In operation, in order to lock the portable carrier 10 in the closed position, the locking key 64 is inserted into a hole 78 in the upper lock housing 73. Inside the upper lock housing 73, the locking tooth 66 of the locking key 64 engages the latching tooth. 86 of the locking latch member 80. If the small child tries to open the cover member 34 of the carrier 10 by pulling the finger tab of the zipper 62, the locked locking key 64 prevents him or her from doing so. Also, if the child tries to rotate the locking dial 98 of the locking device 70, the locking dial 98 would idly rotate without engaging the actuator plate 90 as the teeth of the locking dial 98 are disengaged from the teeth 94 of the actuator plate 90. In order to unlock the child-resistant locking device 70, the user has to push the locking dial 98 so as to compress the elastic buffer plate 96 and engage the teeth of the locking dial 98 with the teeth 94 of the actuator plate 90. Then, the user rotates the locking dial 98 in an unlocking direction while continuing to axially push the locking dial 98, as illustrated in FIG. 20. As a result, the actuator pin 92 rotates the locking latch member 80, thus disengaging the locking tooth 66 of the locking key 64 from the latching tooth 86 of the locking latch member 80. Thus, no key are required to open or close the locking device 70. The locking device 70 may include a spring member 88 adapted to eject the locking key 64 from the upper lock housing 73 through the hole 78 therein.

Alternatively, the plurality of radially outwardly extending teeth (not shown) may be formed on a substantially annular outer peripheral surface 95 of the actuator plate 90, while the locking dial 98 is provided with a plurality of complementary, radially inwardly extending teeth (not shown) radially spaced from the teeth of the actuator plate 90. In order to open the locking device 70, the user has to squeeze the locking dial 98 and twist it in the unlocking direction. The described alternative structure of the child-resistant locking device 70 does not require the elastic buffer plate 96 disposed between the actuator plate 90 and the locking dial 98.

As illustrated in FIGS. 1 and 2, the child-resistant locking device 70 is centered to a lateral side surface 18*a* of the enclosing wall 18 of the base housing 12. Moreover, the flexible cover member 34 is provided with a semi-circular recess 37 adapted to snuggly fit around a complementary semi-cylindrical cover portion 73' of the upper lock housing 73 of the locking device 70 in the first, closed position, and around a complementary semi-cylindrical cover portion 72' of the lower lock housing 72 of the locking device 70 in the second, open position.

As previously described, the vapor barrier 71 adapted to prevent spills and vapors of the harmful cleaning chemicals from escaping the portable carrier 10 when the flexible cover member 34 is in the first, closed position, is disposed between the base housing 12 and the locking device 70. Furthermore, the vapor barrier may be attached to the flexible cover member 34 around the opening 35 therein, or to the handle member 24, particularly to the cover support flange 32 facing the flexible cover member 34.

Figure 21:
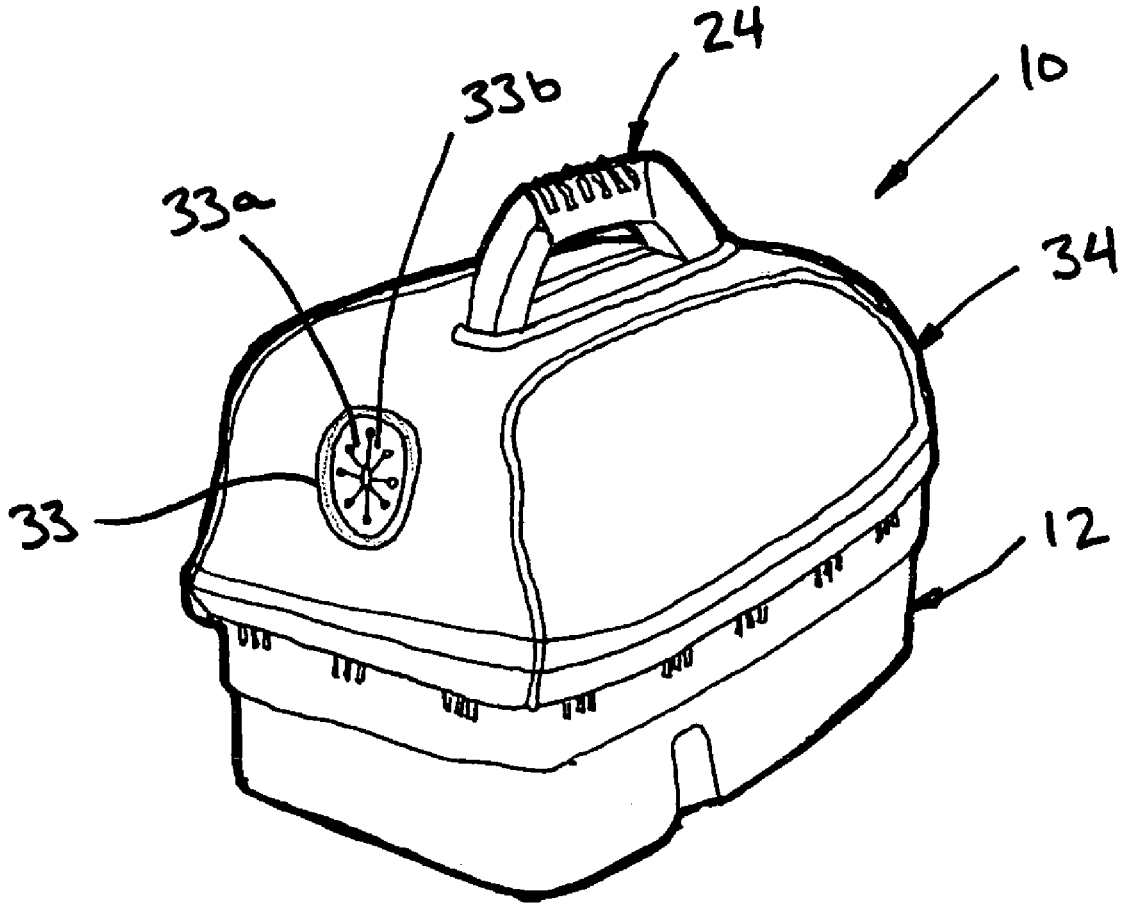
FIG. 21 is a perspective view of the portable carrier in accordance with the first exemplary embodiment of the present invention in a closed position having a paper towel dispensing device.

Furthermore, as illustrated in FIG. 21, the portable carrier 10 may include a paper towel dispensing device 33 provided in the flexible cover member 34. Preferably, the paper towel dispensing device 33 includes a circular plate 33*a* of rubber, plastic or the like having a plurality of flexible projections that allow paper towels to be dispensed while the portable carrier 10 is in the closed position.

As further illustrated in FIGS. 1, 2 and 8, the portable carrier 10 in accordance with the first exemplary embodiment of the present invention includes a reversible window 39 formed in the flexible cover member 34 for allowing visual access into contents of the internal cavity 14 of the carrier 10. Preferably, the window 39 is formed of a sheet 39*a* of a transparent plastic material covering an opening cut in the flexible cover member 34. It will be appreciated that the flexible cover member 34 of the portable carrier 10 may have more than one window. Preferably, the flexible cover member 34 in accordance with the first exemplary embodiment of the preset invention has two windows provided on the opposite sides thereof. Moreover, the window 39 may be arranged in the form of a transparent pocket for inserting a card for displaying a name of the user and/or listing the content of the portable carrier 10.

The flexible cover member 34 is further preferably provided with side pockets 41 that are attached to the inside of the cover member 34 so that when the carrier 10 is in the open position the pockets 41 are accessible, as shown in FIGS. 2 and 3. It will be appreciated by those skilled in the art that the pockets 41 may either have elastic enclosures, hook and loop or snaps.

Figure 22:
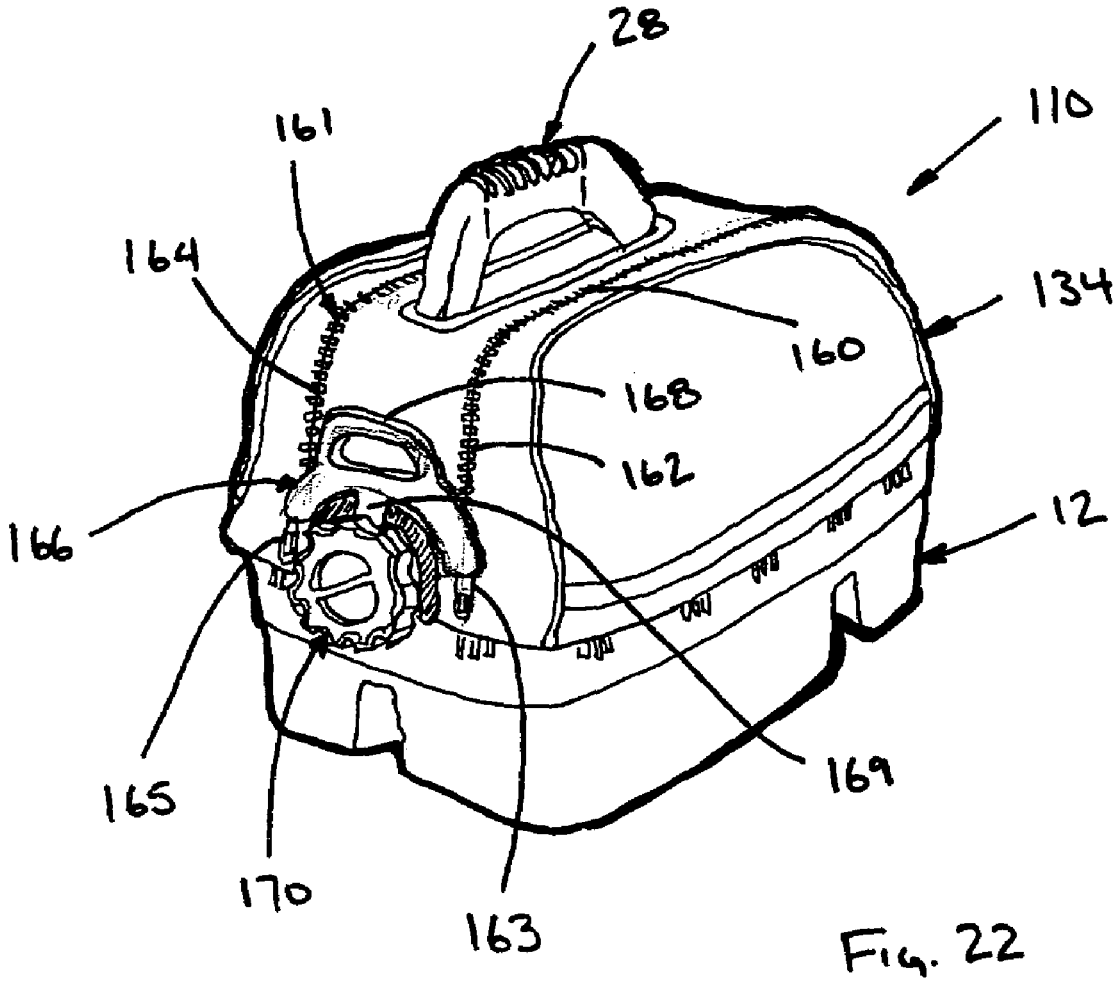
FIG. 22 is a perspective view of a portable carrier in accordance with the second exemplary embodiment of the present invention in a first, closed position.

FIG. 22 illustrates a second exemplary embodiment of the portable carrier of the present invention. In FIG. 22, components, which are unchanged from, or function in the same way as in the first exemplary embodiment depicted in FIGS. 1–8, are designated by the same reference numerals. A portable carrier 110 of the second exemplary embodiment of the present invention is structurally similar and substantially corresponds to the portable carrier 10 of FIGS. 1–8, and only the closure member, which differs, will therefore be explained in detail below.

In the portable carrier 110 in accordance with the second exemplary embodiment of the present invention, a flexible cover member 134 includes two substantially parallel closure members 160 and 161 each having a reversible zipper indicated at 162 and 164 respectively.

The zippers 162 and 164 are operated by sliders 163 and 165 respectively. The sliders 163 and 165 are coupled to a single pulling tab 166 for pulling the sliders 163 and 165 simultaneously to open or close the zippers 162 and 164. The pulling tab 166 is provided with a locking key 169 formed integrally therewith and a handle 168. The pulling tab 166 is shaped to clear the handle portion 28 while opening or closing the zippers 162 and 164.

The portable carrier 110 further includes a child-resistant locking device 170 provided with an opening (not shown)

adapted to receive and engage the locking key 169 of the pulling tab 166, thus locking the portable carrier 110 in a closed position.

Similarly to the portable carrier 10 of the first exemplary embodiment of the present invention, the flexible cover member 134 of the portable carrier 110 is dimensioned to closely conform an outer peripheral surface of the base housing 12 so that in the second, open position, the flexible cover member 134 is nested under the base housing 12.

Figure 22A:
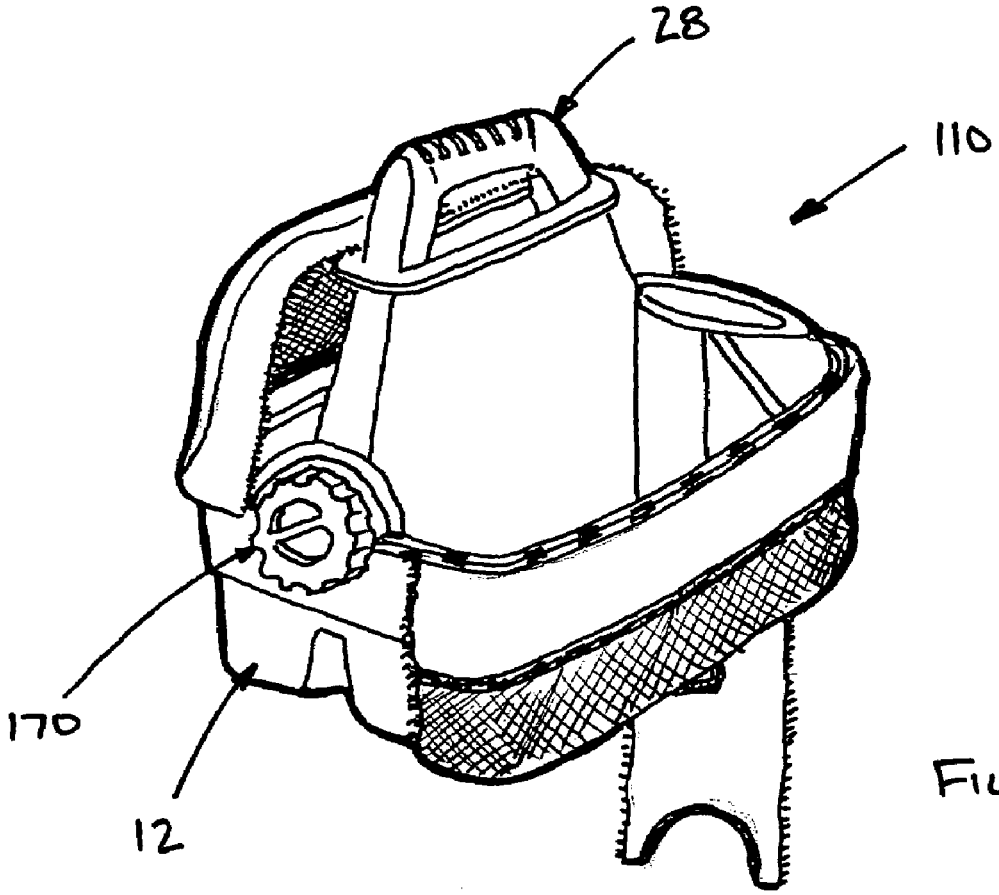
FIG. 22A is a perspective view of the portable carrier in accordance with the second exemplary embodiment of the present invention in a partially open position.

In operation, in order to reconfigure the portable carrier 110 from the first, closed position to the second, open position, the pulling tab 166 of the zippers 162 and 164 is pulled by the user to open the closure members 160 and 161. When the zippers 162 and 164 are fully open, the flexible cover member 134 is reversed and folded over and around the outer peripheral surface of the rigid base housing 12 as partially illustrated in FIG. 22A. In this position, the reversible zippers 162 and 164 are re-closed, thus allowing the flexible cover member 134 to be nested under the base housing 12.

Figure 23:
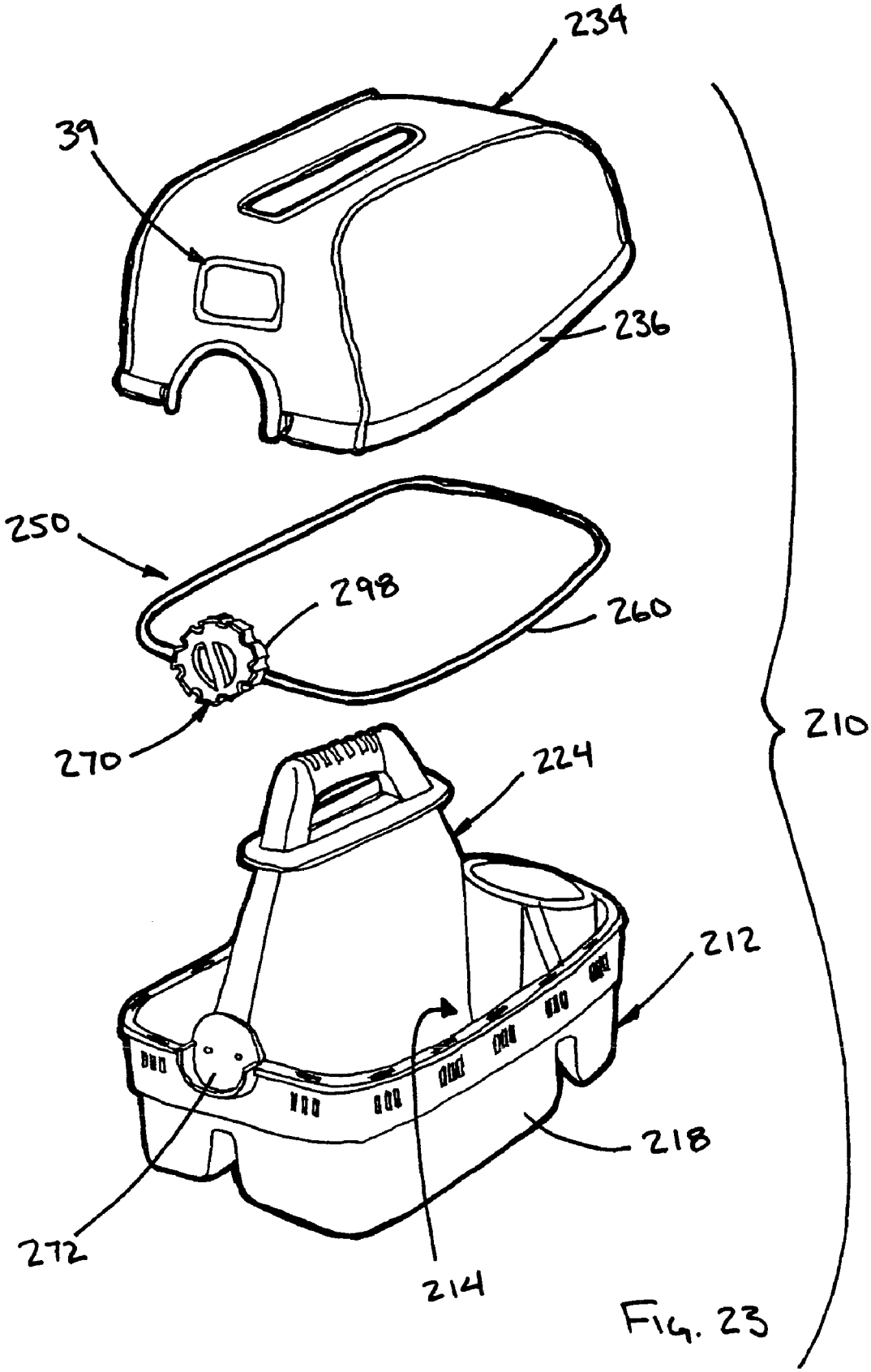
FIG. 23 is an exploded perspective view of a portable carrier in accordance with the third exemplary embodiment of the present invention.

FIG. 23 illustrates a third exemplary embodiment of the portable carrier of the present invention. In FIG. 23, components, which are unchanged from, or function in the same way as in the first exemplary embodiment depicted in FIGS. 1–8, are designated by the same reference numerals. A portable carrier 210 of the third exemplary embodiment of the present invention is structurally similar and substantially corresponds to the portable carrier 10 of FIGS. 1–8, and only the elements, which differ, will therefore be explained in detail below.

The portable carrier 210 in accordance with the third exemplary embodiment of the present invention features a substantially rigid base housing 212 defining an internal cavity 214, a handle member 224 secured to the rigid base housing 212, a flexible cover member 234, and cable locking mechanism 250 adapted to secure the flexible cover member 234 to the base housing 212 in both open and closed positions. The cable locking mechanism 250 includes a flexible cable 260 coupled to a locking device 270 so as to form a closed loop. The flexible cover member 234 is secured to a portion of an enclosing wall 218 of the base housing 212 adjacent to a lower lock housing 272 of the locking device 270 in any appropriate manner well known in the art, such as described above regarding the ways securing the flexible cover member to the base housing in the first exemplary embodiment of the present invention. The flexible cover member 234 includes a tubular lower edge portion 236.

The locking device 270 is adapted to adjust a circumference of the closed loop by increasing or reducing its length. The cable 260 is threaded through the tubular lower edge portion 236 of the flexible cover member 234. Thus, by rotating a locking dial 298 of the locking device 270 the user can tighten the cable 260 to lock the flexible cover member 234 in place or loosen the cable 260 to free the flexible cover member 234 so that it can be removed.

In operation, in order to reconfigure the portable carrier 210 from the first, closed position to the second, open position, the locking dial 298 of the locking device 270 is rotated in an unlocking direction to loosen the cable 260 and free the flexible cover member 234. Then, the flexible cover member 234 is reversed and folded over and around the outer peripheral surface of the rigid base housing 212. In this position, the locking dial 298 of the locking device 270 is rotated in a locking direction to tighten the cable 260 and lock the flexible cover member 234 in place.

Preferably, the locking device 270 has a child-resistant construction, meaning that it is necessary to first push or squeeze then rotate the locking dial 298 in order to tighten or loosen the cable 260.

Figure 24:
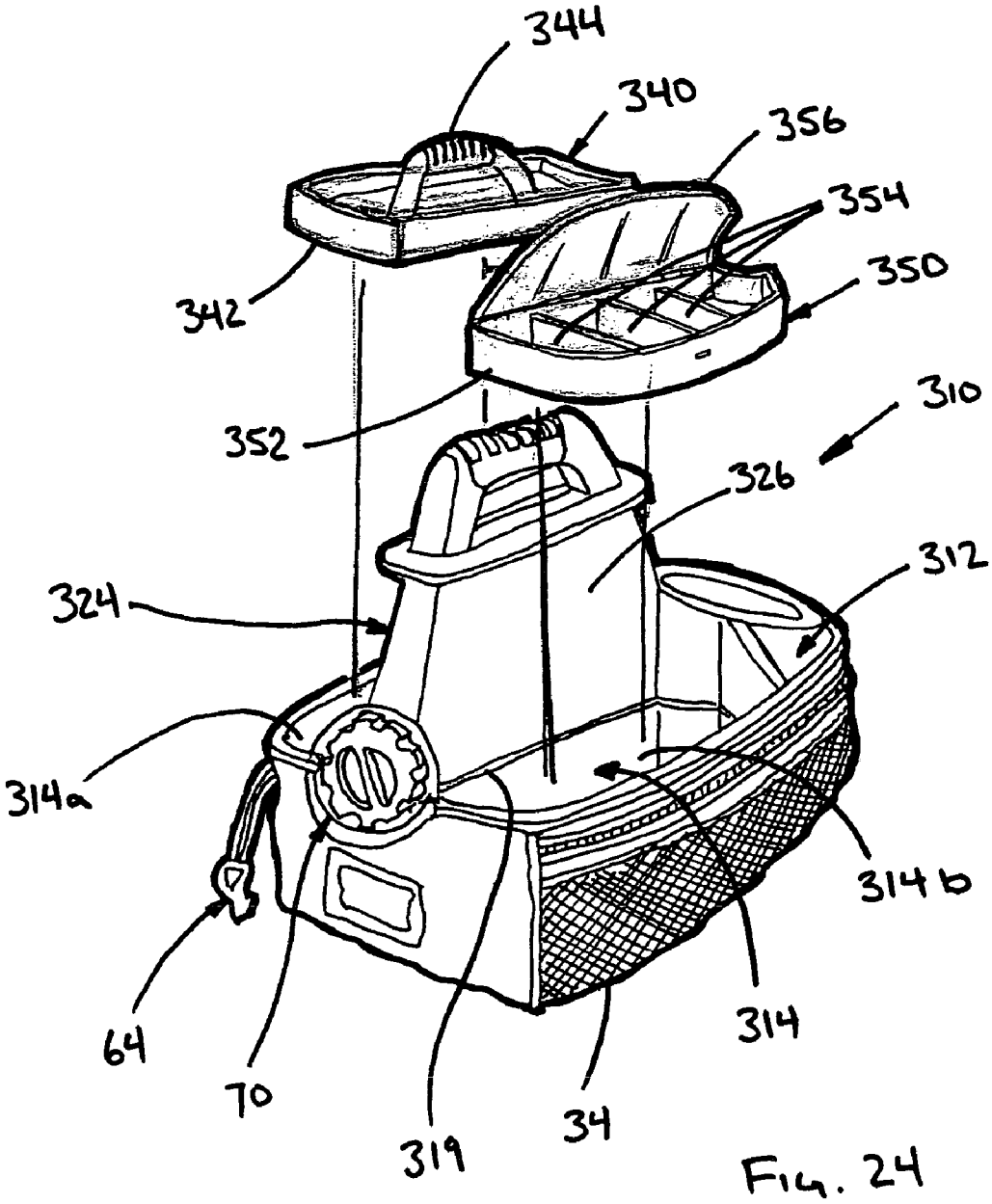
FIG. 24 is a perspective view of a portable carrier in accordance with the fourth exemplary embodiment of the present invention in a second, open position.

FIG. 24 illustrates a fourth exemplary embodiment of the portable carrier of the present invention. In FIG. 24, components, which are unchanged from, or function in the same way as in the first exemplary embodiment depicted in FIGS. 1–8, are designated by the same reference numerals. A portable carrier 310 of the fourth exemplary embodiment of the present invention is structurally similar and substantially corresponds to the portable carrier 10 of FIGS. 1–8, and only the elements, which differ, will therefore be explained in detail below.

The portable carrier 310 in accordance with the fourth exemplary embodiment of the present invention features a substantially rigid base housing 312 defining an internal cavity 314, a handle member 324 secured to the rigid base housing 312, a flexible cover member 34, a child-resistant locking device 70, and two auxiliary insert trays 340 and 350 removably supported within internal cavity 314. A support portion 326 of the handle member 324 partitions the internal cavity 314 into two elongated compartments 314*a* and 314*b*.

Inner peripheral surfaces of each of the compartments 314*a* and 314*b* have substantially horizontally oriented support step 319 adapted to support the auxiliary insert trays 340 and 350 within the compartments 314*a* and 314*b* respectively. The support step 319 is integrally formed with the base housing 312 so that bottom surfaces of the auxiliary insert trays 340 and 350 are spaced from a bottom of the base housing 312, thus providing storage spaces within the compartments 314*a* and 314*b* under the auxiliary insert trays 340 and 350.

In the exemplary embodiment of FIG. 24, the auxiliary insert tray 340 includes an open top casing 342 provided with a handle 344. The auxiliary insert tray 350 includes an open top casing 352, and a lid 356 pivotally mounted to the casing 352. An interior cavity of the casing 352 is divided by partition walls 354 to a number of smaller compartments adapted for storing small articles.

Figure 25:
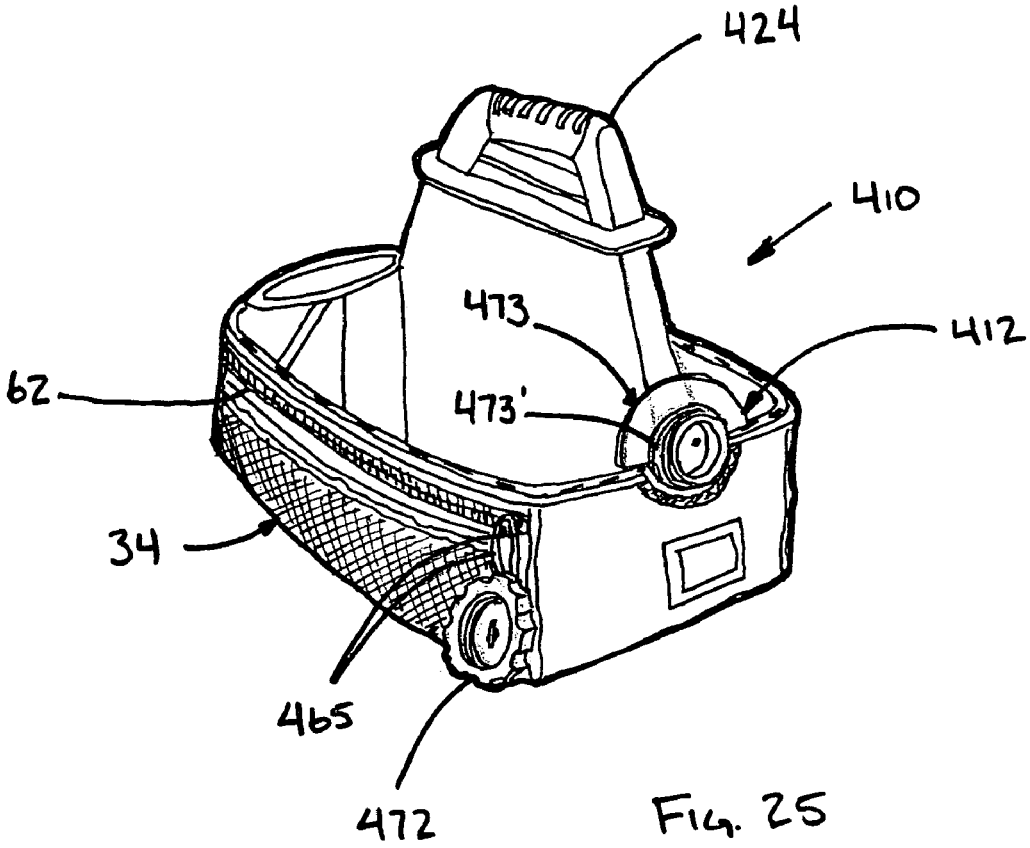
FIG. 25 is a perspective view of a portable carrier in accordance with the fifth exemplary embodiment of the present invention in a second, open position.
Figure 26:
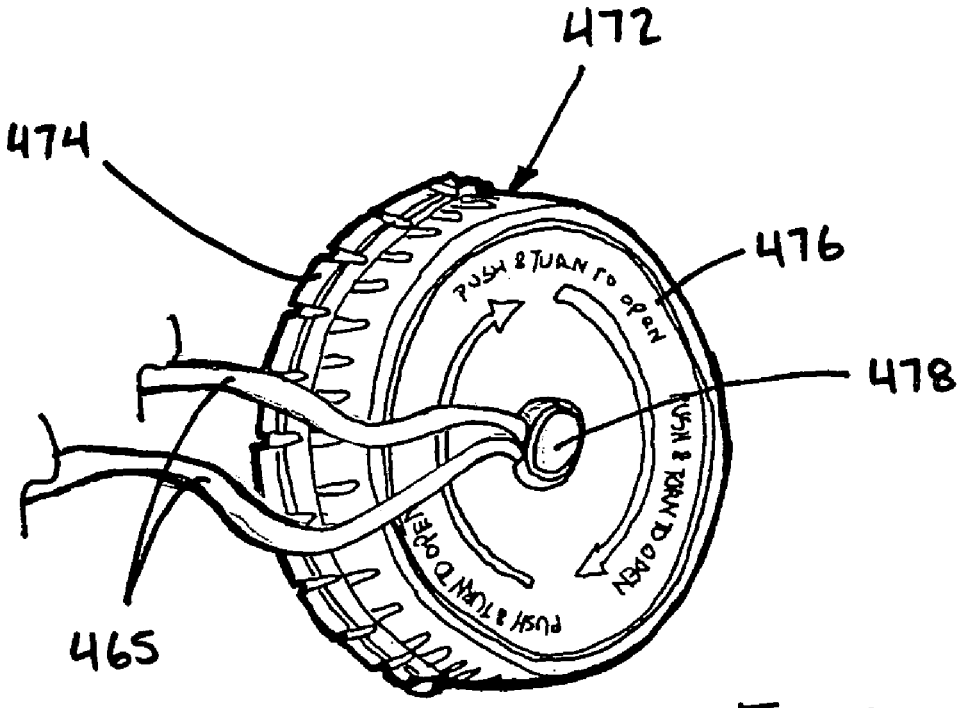
FIG. 26 is a perspective view of a safety cap.

FIGS. 25 and 26 illustrate a fifth exemplary embodiment of the portable carrier of the present invention. In FIG. 25, components, which are unchanged from, or function in the same way as in the first exemplary embodiment depicted in FIGS. 1–8, are designated by the same reference numerals. A portable carrier 410 of the fifth exemplary embodiment of the present invention is structurally similar and substantially corresponds to the portable carrier 10 of FIGS. 1–8, and only the child-resistant locking device, which differs, will therefore be explained in detail below.

The portable carrier 310 in accordance with the fifth exemplary embodiment of the present invention comprises a substantially rigid base housing 412 defining an internal cavity 414, a handle member 424 secured to the rigid base housing 412, a flexible cover member 34, and a child-resistant locking device. Similarly to the portable carrier 10 of the first exemplary embodiment of the present invention, the flexible cover member 434 of the portable carrier 410 is dimensioned to closely conform an outer peripheral surface of the base housing 412 so that in the second, open position, the flexible cover member 34 is nested under the base housing 412, as illustrated in FIG. 25.

A zipper 62 of the flexible cover member 34 is operated by a conventional slider (not shown) and a finger tab (not shown) coupled thereto for pulling the slider to open or close the zipper 62, as is well known to those skilled in the art.

The keyless child-resistant locking device, illustrated in FIGS. 25–26, features a lock support member 473 formed integrally with the base housing 412, and a safety cap 472. The lock support member 473 includes a substantially cylindrical threaded protrusion 473'. Preferably, the safety cap 472 is in the form of a security screw cap well known and widely used in many commercial products such as medicine bottles, for preventing young children from having access to the contents of receptacles when these include dangerous products such as medicaments. Such security screw caps require no key to open the locking device and are readily available commercially as an off-shelf product.

The safety cap 472, illustrated in FIG. 26, has a closed internally screw-threaded inner cap or sleeve 474 clipped in an outer actuator cap 476 which has two axial positions, a pulled-out security position in which it rotates freely and a pushed-in actuating position in which a toothed profile on top or side surface of the inner cap 474 engages in a corresponding toothed profile on top or side surface of the outer actuator cap 476.

In order to open the child-resistant locking device, the user has to push the actuator cap 476 while simultaneously turn it in the unlocking direction to unscrew the safety cap 472 from the threaded protrusion 473' of the base housing 41. Alternatively, the safety cap 472 may be designed so-that the user has to squeeze the actuator cap 476 of the safety cap 472 while simultaneously turn it in the unlocking direction in order to open the child-resistant locking device.

Figure 27:
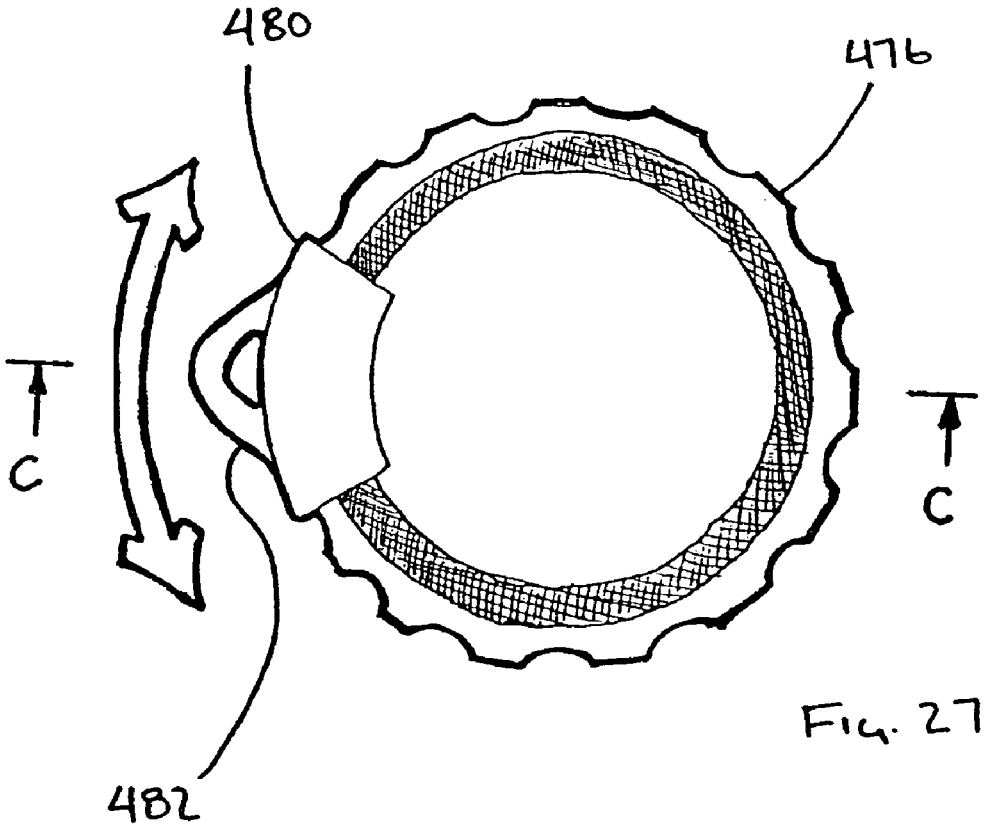
FIG. 27 is a side view of the alternative embodiment of the safety cap.

The portable carrier 410 is further provided with a flexible cord 465 attached directly to the locking dial 476 of the safety cap 472 at one end and to the finger tab of the zipper slider at the other end of the flexible cord 465 by a central pin 478, as shown in detail in FIG. 27.

Figure 28:
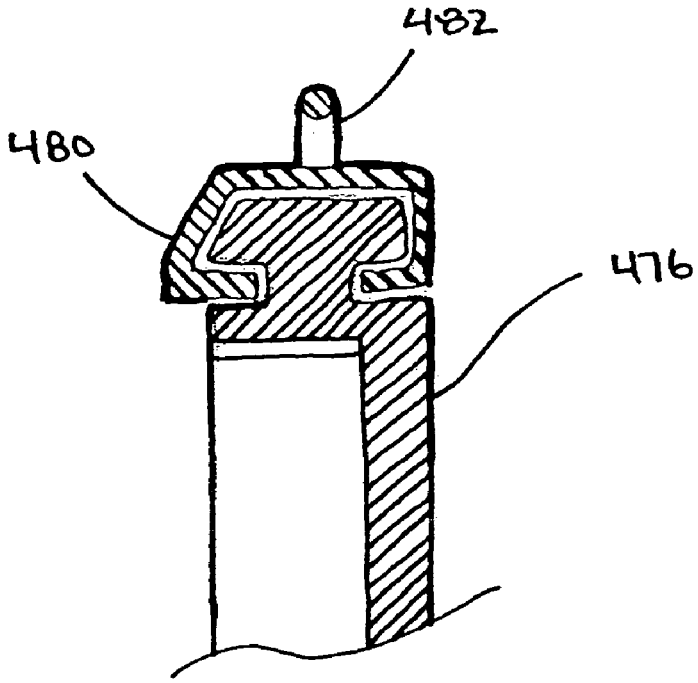
FIG. 28 is a partial cross-sectional view taken along line C—C in FIG. 27 of the alternative embodiment of the safety cap.

Alternatively, as illustrated in FIGS. 27 and 28, the locking dial 476 may be provided with a cord coupler 480 adapted to slide about an outer circumference of the locking dial 476. The coupling member 480 has an eyelet member 482 adapted to attach the flexible cord 465 to the locking dial 476.

In order to open the child-resistant locking device, the user has to push the locking dial 476 of the safety cap 472 and twist it in the unlocking direction. Alternatively, the safety cap 472 may be designed so that the user has to squeeze the locking dial 476 of the safety cap 472 and twist it in the unlocking direction in order to open the child-resistant locking device.

FIG. 29–33 illustrate a sixth exemplary embodiment of the portable carrier of the present invention. In FIGS. 29–33, components, which are unchanged from, or function in the same way as in the first exemplary embodiment depicted in FIGS. 1–8, are designated by the same reference numerals. A portable carrier 510 of the fifth exemplary embodiment of the present invention is structurally similar and substantially corresponds to the portable carrier 10 of FIGS. 1–8, and only the elements, which differ, will therefore be explained in detail below.

Figure 29:
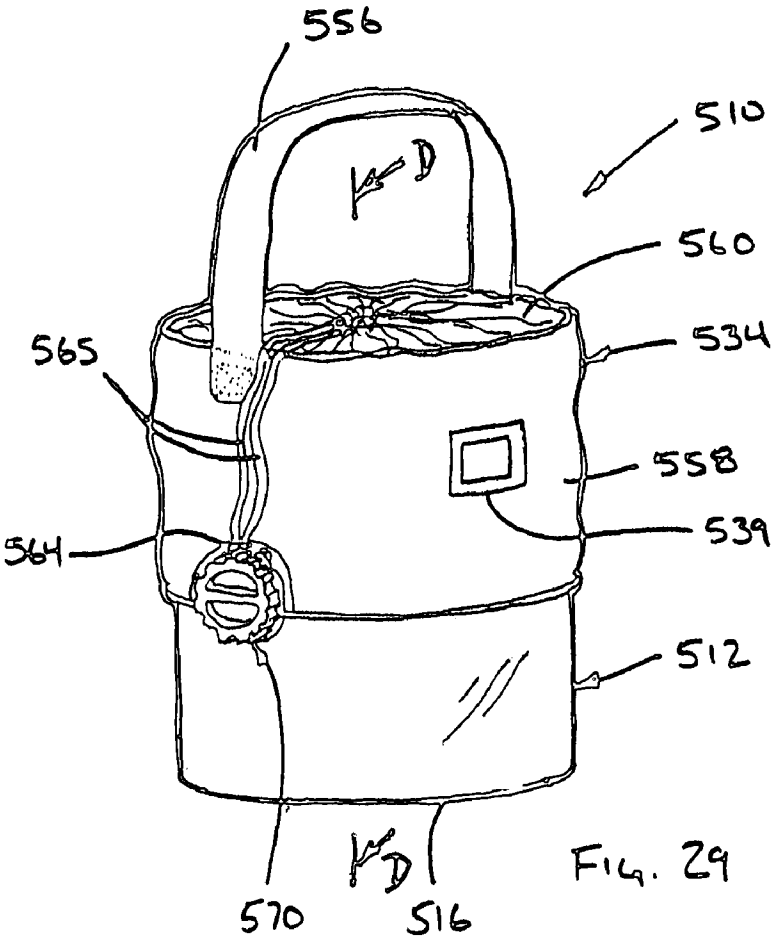
FIG. 29 is a perspective view of a portable carrier in accordance with the sixth exemplary embodiment of the present invention in a first, closed position.
Figure 30:
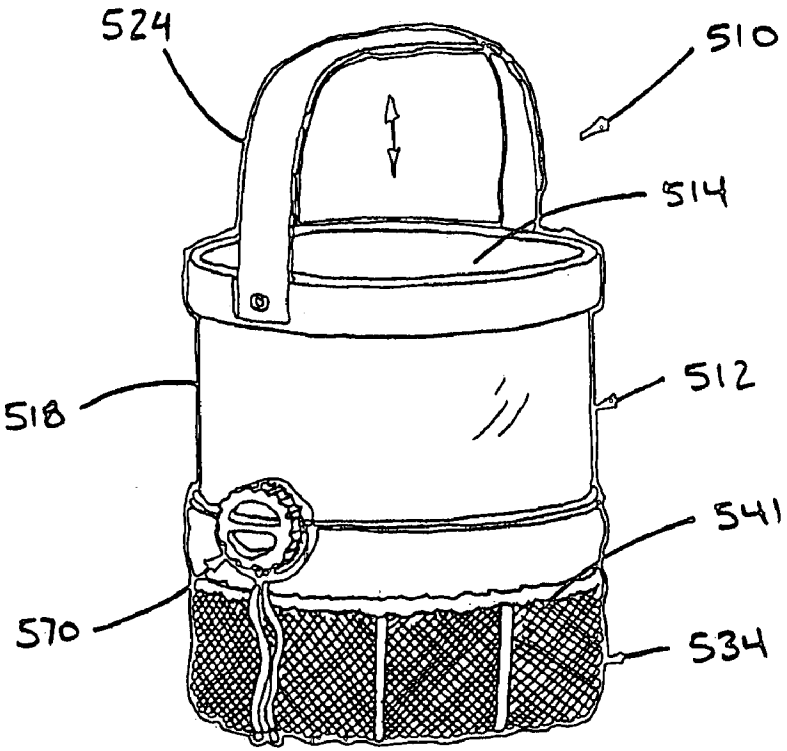
Figure 31:
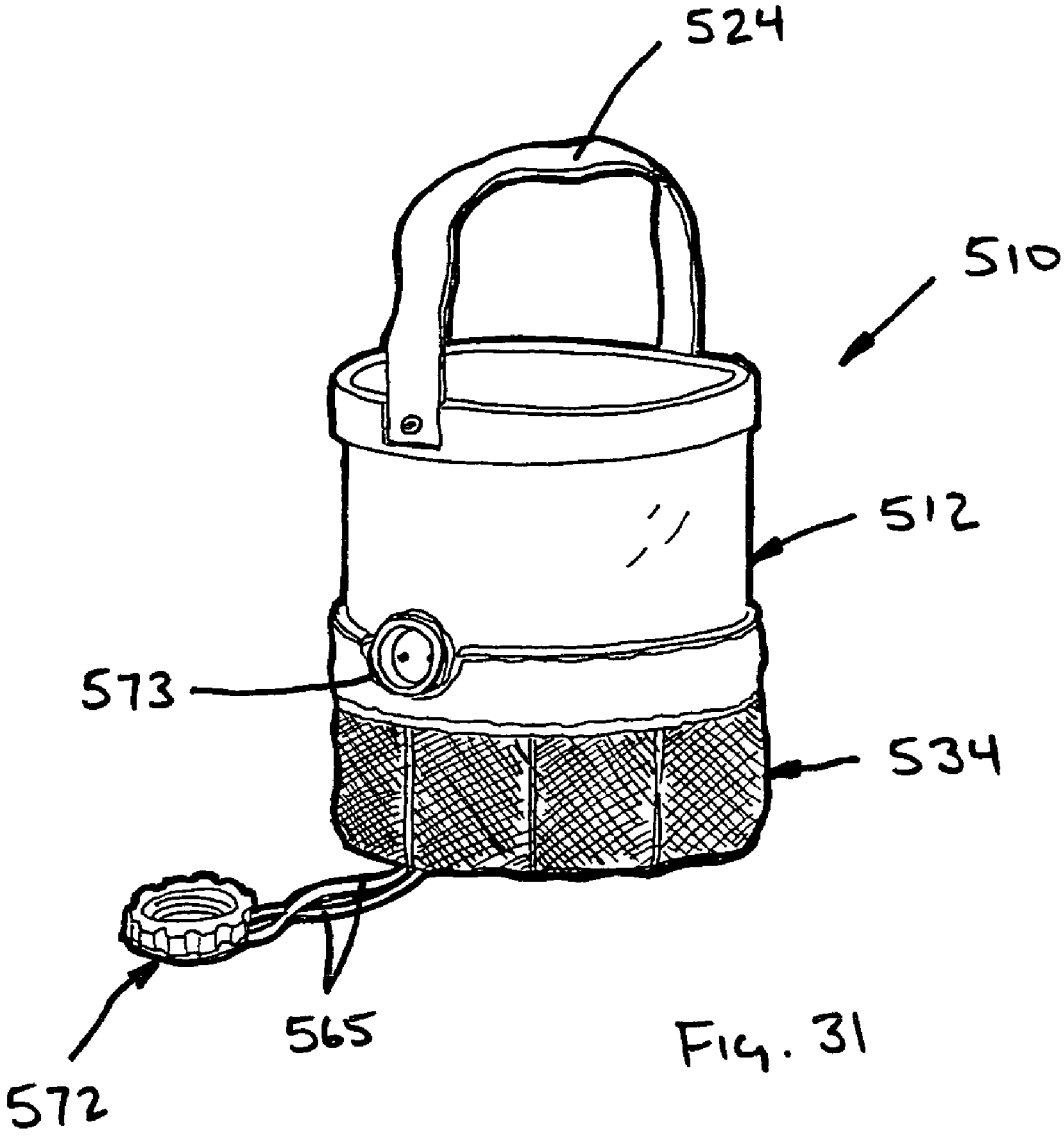
FIG. 31 is a perspective view of the portable carrier in accordance with the sixth exemplary embodiment of the present invention in a second, open position with the safety cap off.

The portable carrier 510 in accordance with the fifth exemplary embodiment of the present invention features a substantially rigid base housing 512 defining an internal cavity 514, and a flexible cover member 534 attached to the rigid base housing 512. The rigid base housing 512 of the portable carrier 510 has a substantially cylindrical, bucket shape. As illustrated in FIG. 29, the flexible cover member 534 is provided with a handle 556 made of a substantially flexible material. Moreover, as illustrated in FIGS. 30 and 31, the rigid base housing 512 is also provided with a handle member 524 secured to the rigid base housing 512. The handle member 524 is made of a substantially flexible material.

The internal cavity 514 of the rigid base housing 512 is defined by a bottom wall 516 and an enclosing wall 518 extending substantially upwardly from the bottom wall 516. Moreover, the rigid base housing 512 has an open top defined by a top edge 520 of the enclosing wall 518. Preferably, an inner peripheral surface of the enclosing wall 518 of the base housing 512 has a substantially horizontally oriented support flange 522 adapted to support an insert plate 517. Further preferably, the base housing 512 is made of a substantially rigid plastic material. It will be appreciated that the base housing 512 may be made of any other appropriate rigid material.

As further illustrated in FIGS. 29–33, the flexible cover member 534 includes a substantially cylindrical side wall 558 and a selectively openable closure member 560 covering the open top of the rigid base housing 512. As shown in FIG. 29, the handle 556 is attached to the cylindrical side wall 558 of the flexible cover member 534.

Preferably, the flexible cover member 534 is provided with a side pocket 541 attached to an inside surface of the side wall 558 of the cover member 34 so that when the carrier 510 is in the open position the pocket 541 is accessible, as shown in FIG. 30. Optionally, the pocket 541 may be divided to a number of smaller pockets. It will be appreciated by those skilled in the art that the pocket 541 may either have elastic enclosures, hook and loop or snaps.

As further illustrated in FIG. 29, the portable carrier 510 in accordance with the sixth exemplary embodiment of the present invention includes a reversible window 539 formed in the flexible cover member 534 for allowing visual access into contents of the internal cavity 514 of the carrier 510. Preferably, the window 539 is formed of a sheet of a transparent plastic material covering an opening cut in the flexible cover member 534. It will be appreciated that the flexible cover member 534 of the portable carrier 510 may have more than one window. Moreover, the window 539 may be arranged in the form of a transparent pocket for inserting a card for displaying a name of the user and/or listing the content of the portable carrier 510.

Figure 32:
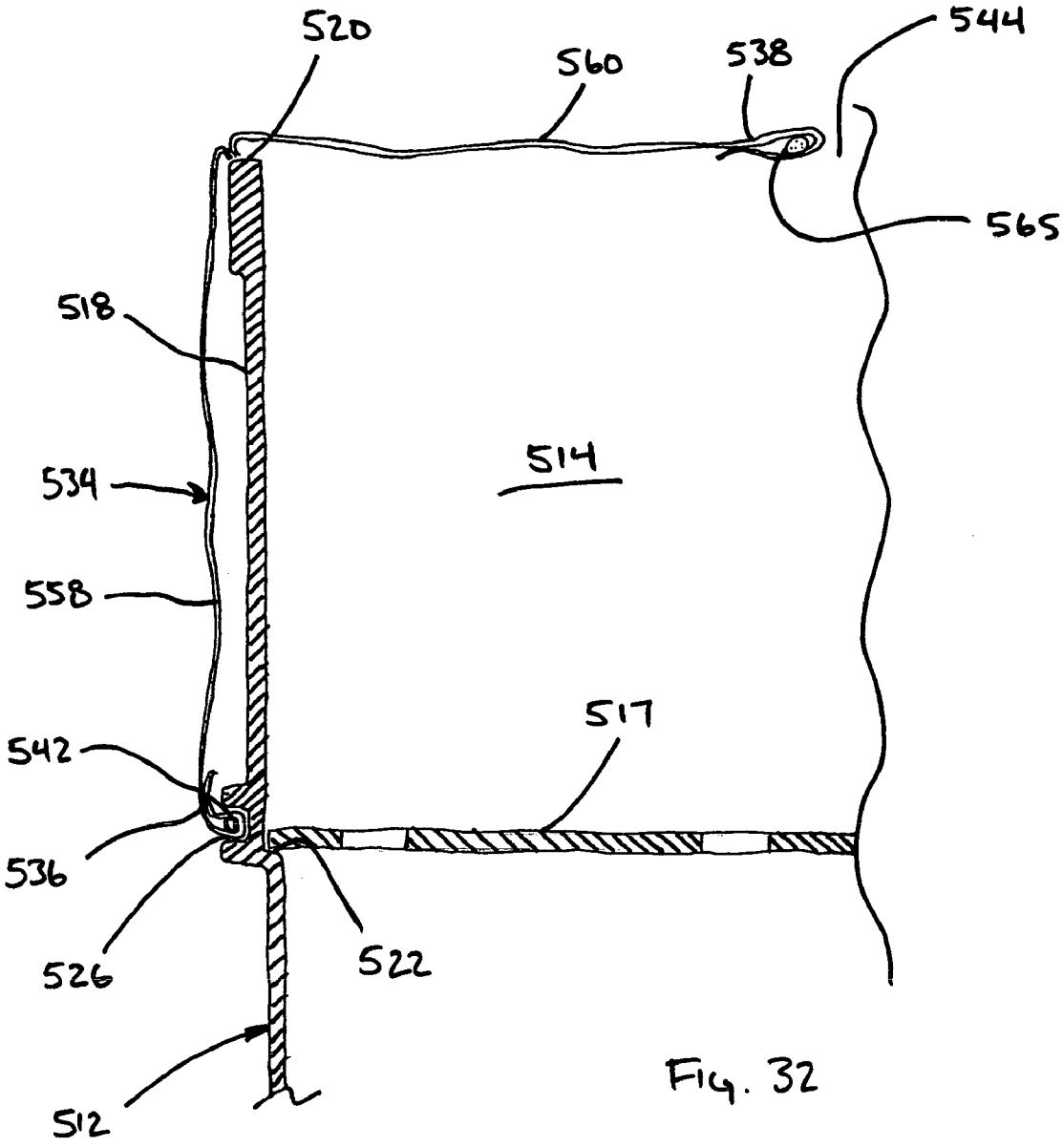
FIG. 32 is partial cross-sectional view of the portable carrier taken along line D—D in FIG. 29 in accordance with the sixth exemplary embodiment of the present invention in the first, closed position.

In the embodiment illustrated in FIG. 32, a lower edge portion 536 of the flexible cover member 534 reinforced with a core 542 is inserted into a mounting channel 526 in the enclosing wall 518. It will be appreciated by those skilled in the art that any other appropriate method of securing the lower edge portion 536 of the flexible cover member 534 to the enclosing wall 518 is within the scope of the present invention.

Further in accordance with the sixth exemplary embodiment of the present invention, the closure member 560 of the flexible cover member 534 includes a tubular inner edge portion 538. The inner edge portion 538 of the flexible cover member 534 defines an adjustable aperture 544 for accessing the interior cavity 514 of the portable carrier 510.

The tubular inner edge portion 538 is used in conjunction with a drawstring 565 or draw tape to gather the inner edge portion 538 of the flexible cover member 534 together to close the aperture 544. The drawstring 565 may feature an elongated material such as, for example, cotton, hemp, jute, leather, flax, silk, wool, rubber, nylon, rayon, Kevlar, vinyl, etc. that is formed into a cord, rope, line, lace, band or tape.

The drawstring 565 may be an elongated member possessing two ends or may be joined in a continuous loop. The drawstring 565 is threaded through the inner edge portion 538 of the flexible cover member 534 so that, by drawing the ends or a section of the drawstring 565, the aperture 544 is decreased in size to close the aperture 544.

The portable carrier 510 of the sixth exemplary embodiment of the present invention is selectively reconfigurable between a first, closed position, shown in FIG. 29, preventing access to the internal cavity 514, and a second, open position, shown in FIGS. 30 and 31, providing access to the internal cavity 514. As illustrated, in the first, closed position, the handle member 524 is folded within the interior cavity 514 of the base housing 512 under the closure member 560 of the flexible cover member 534, and the carrier 510 is transported by the user by holding the handle 556 attached to the flexible cover member 534. However, when the portable carrier 510 is in second, open position, the handle 556 is disposed between the bottom wall 516 of the rigid base housing 512 and the flexible cover member 534, and the carrier 510 is transported by the user by holding the handle member 524 attached to the rigid base housing 512.

Figure 33:
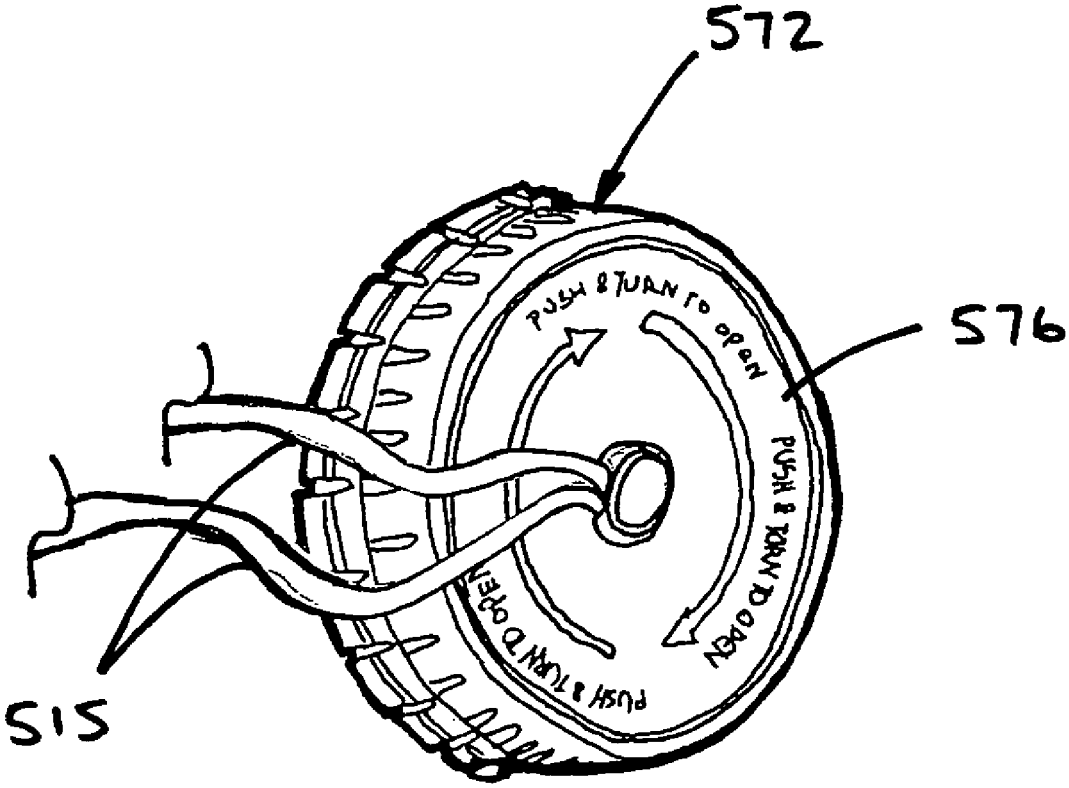
FIG. 33 is a perspective view of the safety cap.
Figure 34:
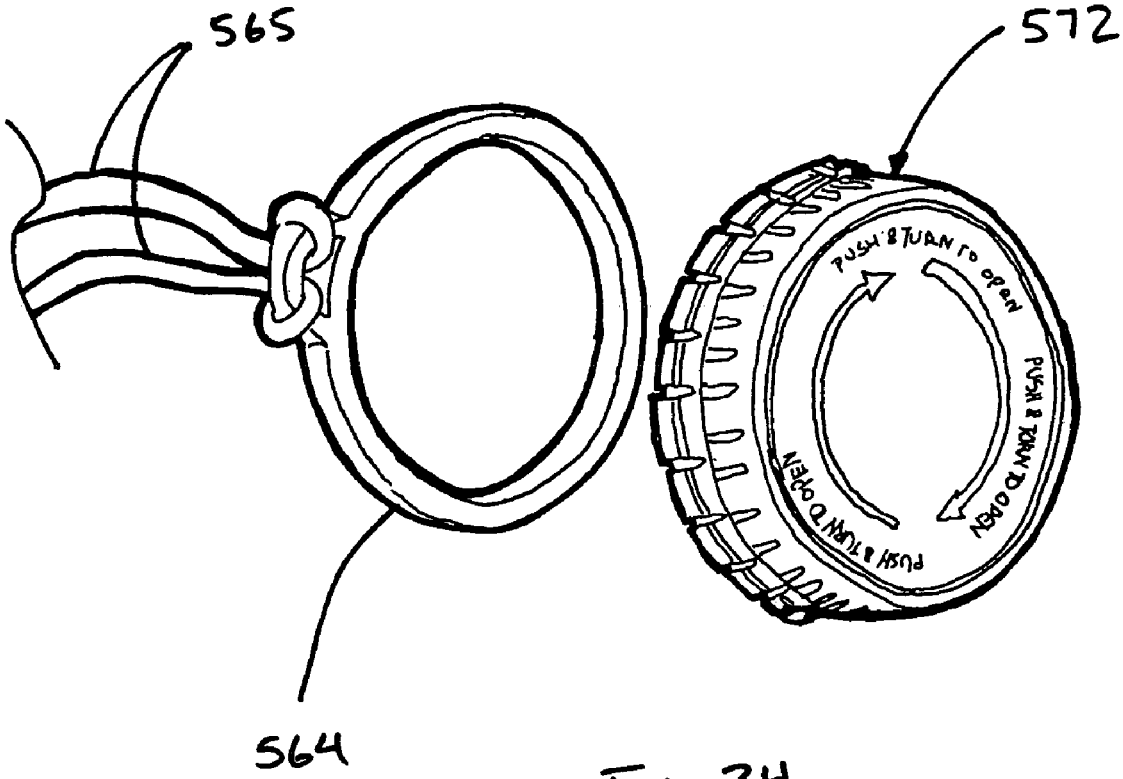
FIG. 34 shows an alternative embodiment of the safety cap.

The portable carrier 510 in accordance with the sixth exemplary embodiment of the present invention is further provided with a child-resistant locking device 570 adapted to prevent small children from accessing the objects, such as harmful cleaning chemicals, stored in the internal cavity 514 of the carrier 510. The child-resistant locking device 570, illustrated in detail in FIGS. 33 and 34, is substantially similar to the child-resistant locking device illustrated in FIGS. 25–27, and features a lock support member in the form of a substantially cylindrical threaded protrusion 573 formed integrally with the base housing 512, and a safety cap 572. Preferably, as illustrated in FIGS. 30–33, ends of the drawstring 565 are attached directly to the locking dial 574 of the safety cap 572.

In order to open the child-resistant locking device, the user has to push the safety cap 572 and twist it in the unlocking direction. Alternatively, the safety cap 572 may be designed so that the user has to squeeze the safety cap 572 and twist it in the unlocking direction in order to open the child-resistant locking device 570.

Alternatively, distal ends of the drawstring 565 is attached to a locking ring 564, shown in FIG. 34. In the locked position, the locking ring 564 is mounted to the threaded protrusion 573 of the base housing 512 between the enclosing wall 518 and the safety cap 572. In order to reconfigure the portable carrier 510 from the first, closed position (shown in FIG. 29) to the second, open position (shown in FIG. 30), the locking ring 564 is first disengaged from the rigid base housing 512 by removing the safety cap 572.

It will be appreciated by those skilled in the art that any appropriate arrangement of the child-resistant locking device and the safety cap may be employed.

Similarly to the portable carrier 10 of the first exemplary embodiment of the present invention, the flexible cover member 534 of the portable carrier 510 is dimensioned to closely conform an outer peripheral surface of the base housing 212 so that in the second, open position, the flexible cover member 534 is nested under the base housing 512, as illustrated in FIGS. 30 and 31.

Figure 29A:
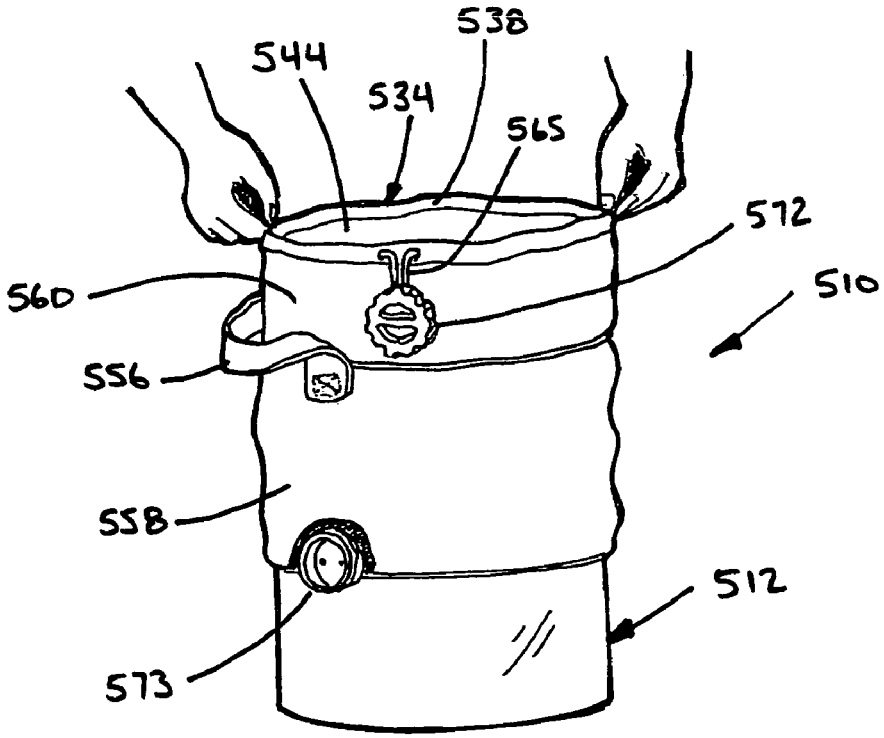
FIG. 29A is a perspective view of the portable carrier in accordance with the sixth exemplary embodiment of the present invention shown with an open aperture defined by an inner edge portion of a flexible cover member.
Figure 29B:
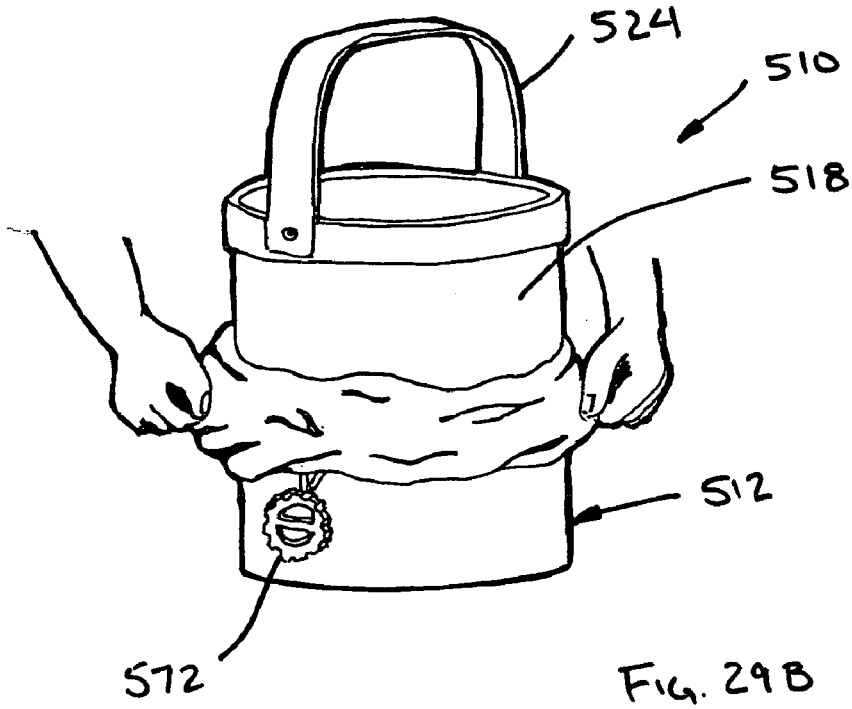
FIG. 29B is a perspective view of the portable carrier in accordance with the sixth exemplary embodiment of the present invention in a partially open position.

In operation, in order to reconfigure the portable carrier 510 from the first, closed position to the second, open position, the adjustable aperture 544 defined by the inner edge portion 538 of the flexible cover member 534 is enlarged wide enough to be reversed and folded over and around the outer peripheral surface of the rigid base housing 512 as illustrated in stages in FIGS. 29A, 29B and 31. In this position, the adjustable aperture 544 is re-closed by drawing the drawstring 565, then threading the safety cap 572 onto the threaded protrusion 573 as illustrated in FIG. 30, thus locking the child-resistant locking device 570.

Figure 35:
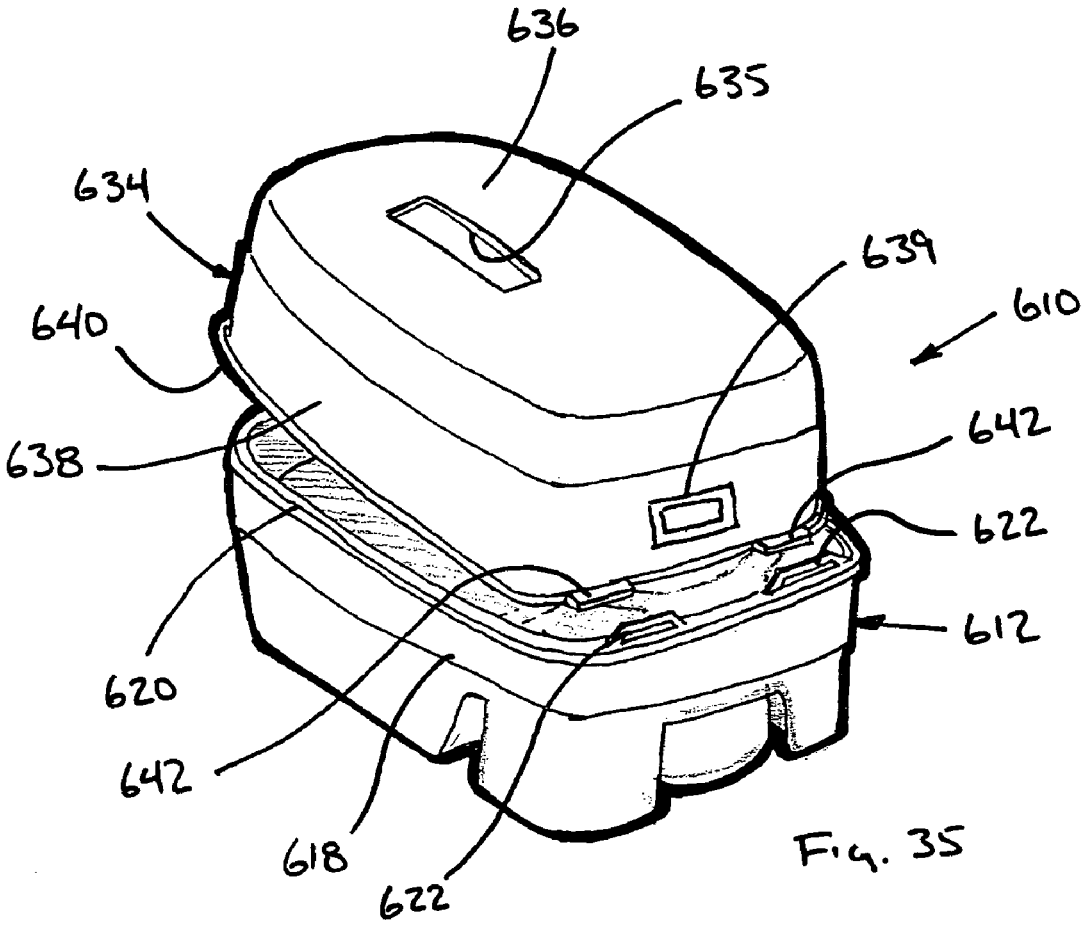
FIG. 35 is a perspective view of a portable carrier in accordance with the seventh exemplary embodiment of the present invention with a removed cover member.
Figure 36:
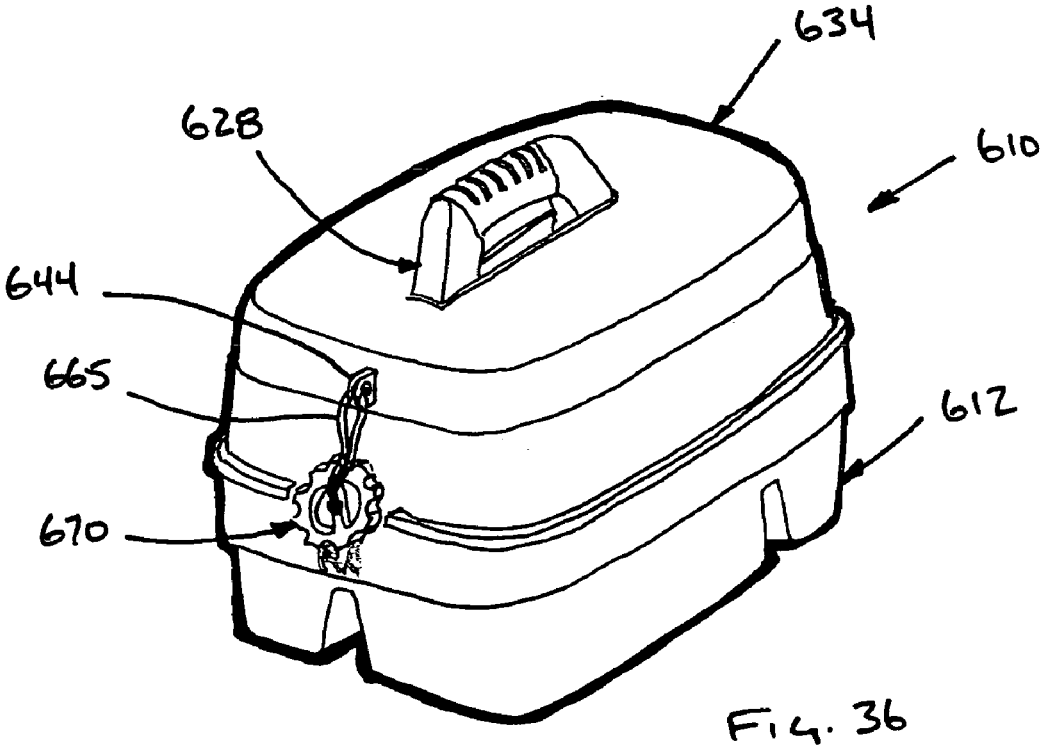
FIG. 36 is a perspective view of a portable carrier in accordance with the seventh exemplary embodiment of the present invention in a first, closed position.
Figure 37:
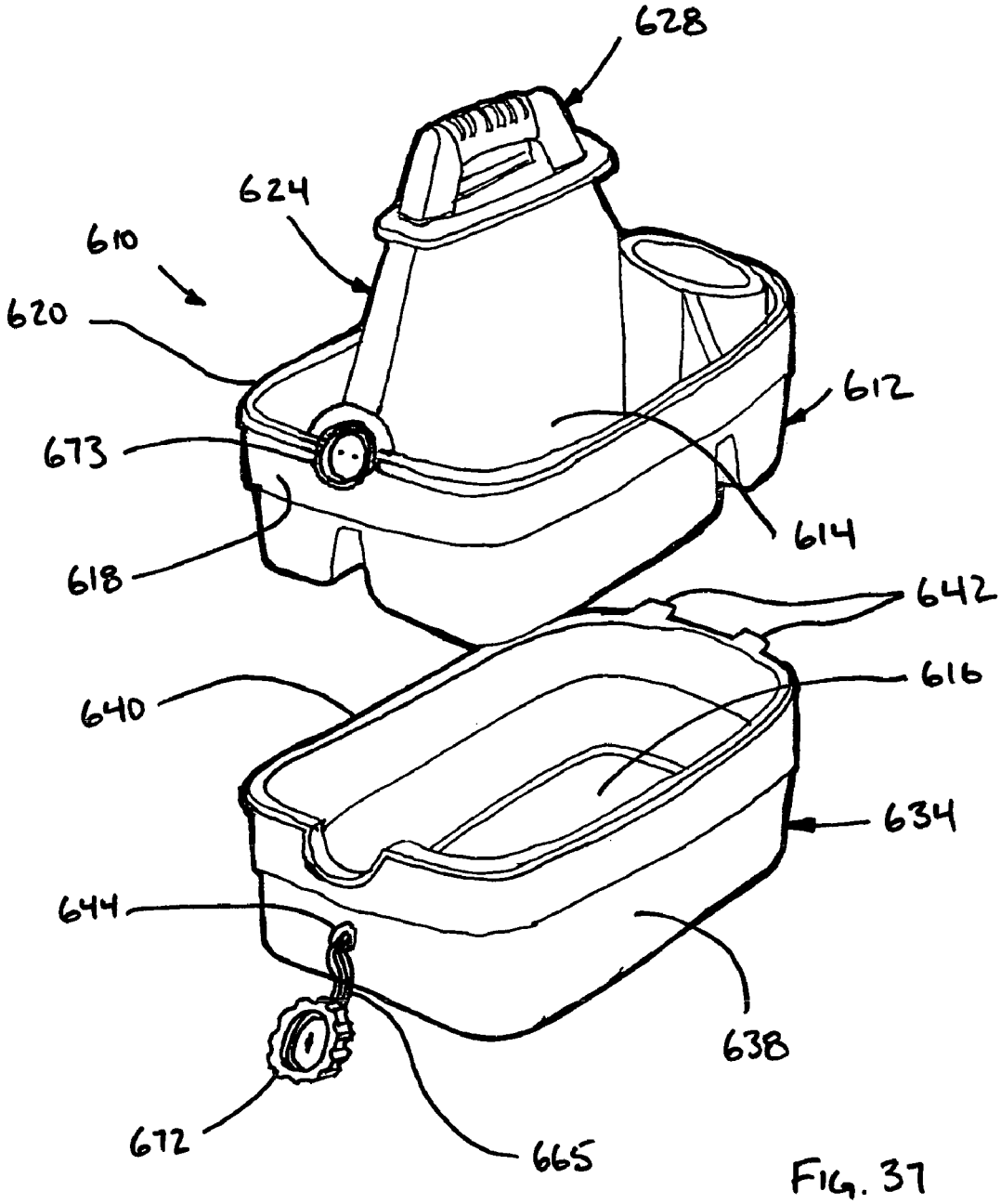
FIG. 37 is a perspective view of the portable carrier in accordance with the seventh exemplary embodiment of the present invention in an open position with the cover member shown underneath a base housing.

FIGS. 35–37 illustrate a seventh exemplary embodiment of the portable carrier of the present invention. In FIGS. 35–37, components, which are unchanged from, or function in the same way as in the first exemplary embodiment depicted in FIGS. 1–8, are designated by the same reference numerals. A portable carrier 610 of the seventh exemplary embodiment of the present invention is structurally similar and substantially corresponds to the portable carrier 10 of FIGS. 1–8, and only a cover member and child-resistant locking device, which differ, will therefore be explained in detail below.

The portable carrier 610 in accordance with the seventh exemplary embodiment of the present invention features a substantially rigid base housing 612 defining an internal cavity 614, a handle member 624 secured to the rigid base housing 612, a substantially rigid cover member 634 removably secured to the base housing 612, and a child-resistant locking device 670. Moreover, the rigid base housing 612 has an open top defined by a top flange 620 of an enclosing wall 618. Preferably, the base housing 612 is made of a substantially rigid plastic material. It will be appreciated that the base housing 612 may be made of any other appropriate rigid material.

As illustrated in FIGS. 35–37, the base housing 612 is substantially rectangular in cross-section. However, it will be appreciated that alternatively, the base housing 612 may have any appropriate cross-section, such as circular, oval, square, pentagonal, hexagonal, etc.

Preferably, the rigid cover member 634 is also made of a substantially rigid plastic material. It will be appreciated that the base housing 612 may be made of any other appropriate rigid material. The rigid cover member 634 includes a top wall 636 and an enclosing wall 638 extending substantially downwardly from the top wall 636. Moreover, the rigid cover member 634 has an open bottom defined by a bottom flange 640 of the enclosing wall 638. The geometrical configuration of the bottom flange 640 of the cover member 634 substantially corresponds to the top flange 620 of the base housing 612.

As further illustrated in FIG. 35, the portable carrier 610 includes a window 639 formed in the cover member 634 for allowing visual access into contents of the internal cavity 614 of the carrier 610. Preferably, the window 639 is formed of a sheet of a transparent plastic material covering an opening cut in the cover member 634. It will be appreciated that the cover member 634 of the portable carrier 610 may have more than one window. Moreover, the window 639 may be arranged in the form of a transparent pocket for inserting a card for displaying a name of the user and/or listing the content of the portable carrier 610.

As illustrated, the handle member 624 extends from the cover member 634 through an opening 635 therein. More specifically, as illustrated in FIG. 36, only a handle portion 628 of the handle member 624 extends from the cover member 634.

As further shown in FIG. 35, the top flange 620 of the base housing 612 is provided with a pair of slots 622, while the bottom flange 640 of the cover member 634 is provided with complementary projections 642 formed integrally therewith. The slots 622 of the base housing 612 are adapted to receive the projections 642 of the cover member 634 in order to secure the cover member 634 to the base housing 612. It will be appreciated that more or less than two projections 642 and slots 622 may be employed.

The portable carrier 610 is selectively reconfigured between a first, closed position, illustrated in FIG. 36, preventing access to the internal cavity 614 when the rigid cover member 634 closes the open top of the base housing 612, and a second, open position, illustrated in FIG. 37, providing access to the internal cavity 614 to allow items to be placed or removed therefrom when the rigid cover member 634 is removed from the top edge 620 of the rigid base housing 612. Moreover, the rigid cover member 634 of the portable carrier 610 is dimensioned to closely conform an outer peripheral surface of the base housing 612 so that in the second, open position, the rigid cover member 634 is nested under the base housing 612. The cover member 634 is preferably about the same size as the housing and its interior has a complementary shape to the bottom of the housing 612.

In order to prevent small children and mentally disturbed persons from accessing the objects, such as harmful cleaning chemicals, stored in the internal cavity 614 of the carrier 610, the carrier 610 is further provided with a child-resistant locking device 670. The child-resistant locking device 670 is substantially identical to the child-resistant locking device illustrated in FIGS. 25–27, and features a lock support member in the form of a substantially cylindrical threaded protrusion 673 formed integrally with the base housing 612, and a safety cap 672. The safety cap 672 is secured to the rigid cover member 634 through a cord 665. As illustrated in FIGS. 36 and 37, one end of the cord 665 is attached directly to the safety cap 672, while the other end of the cord 665 is attached to the bracket 644 formed integrally with the cover member 634.

In operation, in order to reconfigure the portable carrier 610 into the first, closed position, the projections 642 of the cover member 634 are inserted into the slots 622, then the cover member 634 is pressed down toward the base housing 612 so that the bottom flange 640 of the cover member 634 frictionally engages the top flange 620 of the base housing 612 creating a vapor seal around a perimeter of the open top of the base housing 612. Finally, the safety cap 672 is threaded onto the threaded protrusion 673 of the base housing 612. It would be understood by those skilled in the art that without first removing the safety cap 672, the portable carrier 610 cannot be transformed into the second, open position. In order to reconfigure the portable carrier 610 into the second, open position, first the safety cap 672 is removed from the base housing 612 by pushing the safety cap 672 while simultaneously turning it in the unlocking direction to unscrew the safety cap 472 from the threaded protrusion 473 of the base housing 612. The, the cover member 634 is removed from the base housing 612, turned over and nested underneath the base housing 612. The cover member 634 is held in place by a friction fit. In addition, the safety cap 672 may be threaded onto the protrusion 473 of the base housing 612 in order to prevent incidental lost of the cover member 634.

Figure 38:
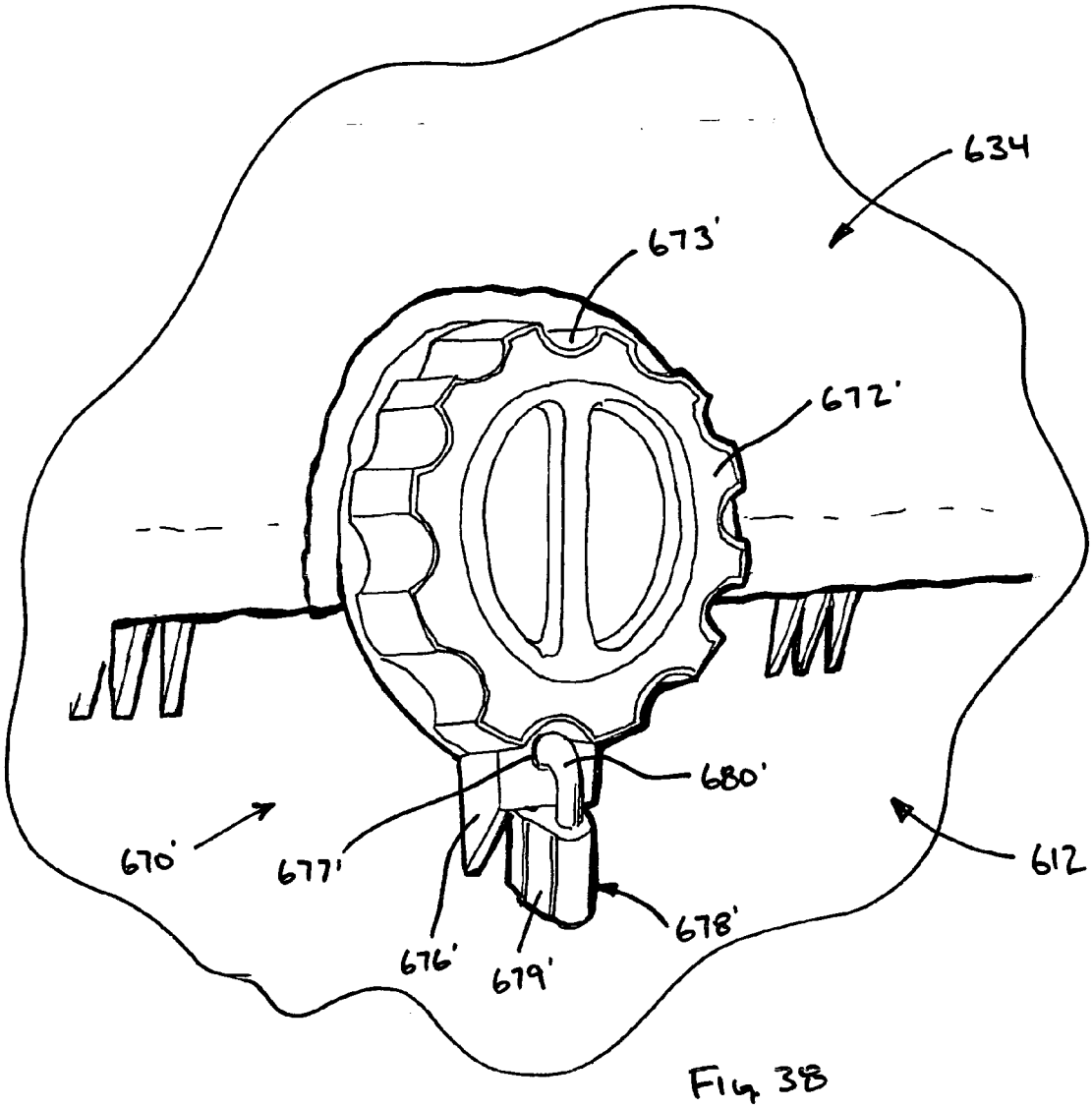
FIG. 38 is a perspective view of an alternative locking device in accordance with the present invention.
Figure 39:
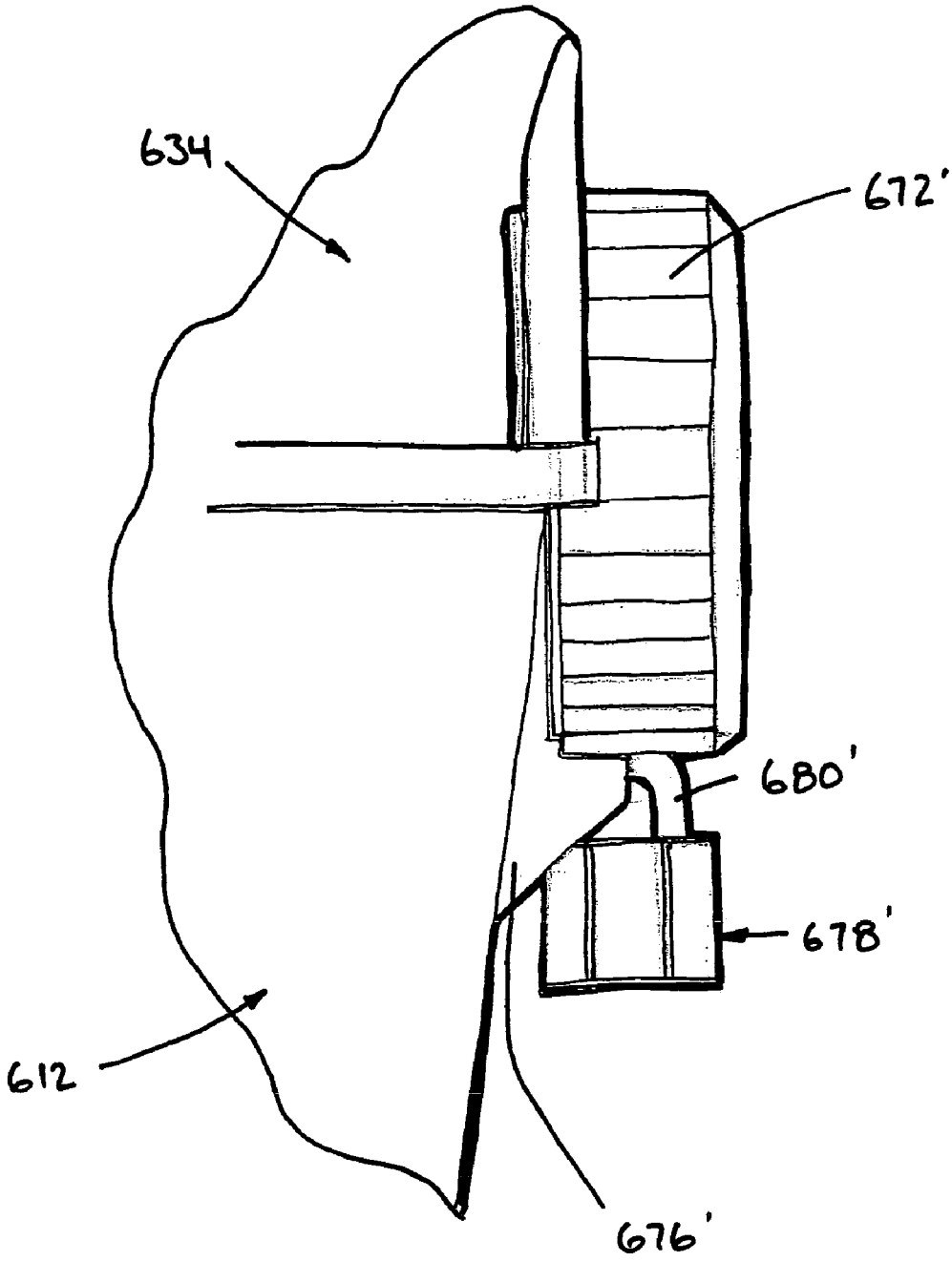
FIG. 39 is a side view of the alternative locking device in accordance with the present invention.
Figure 40:
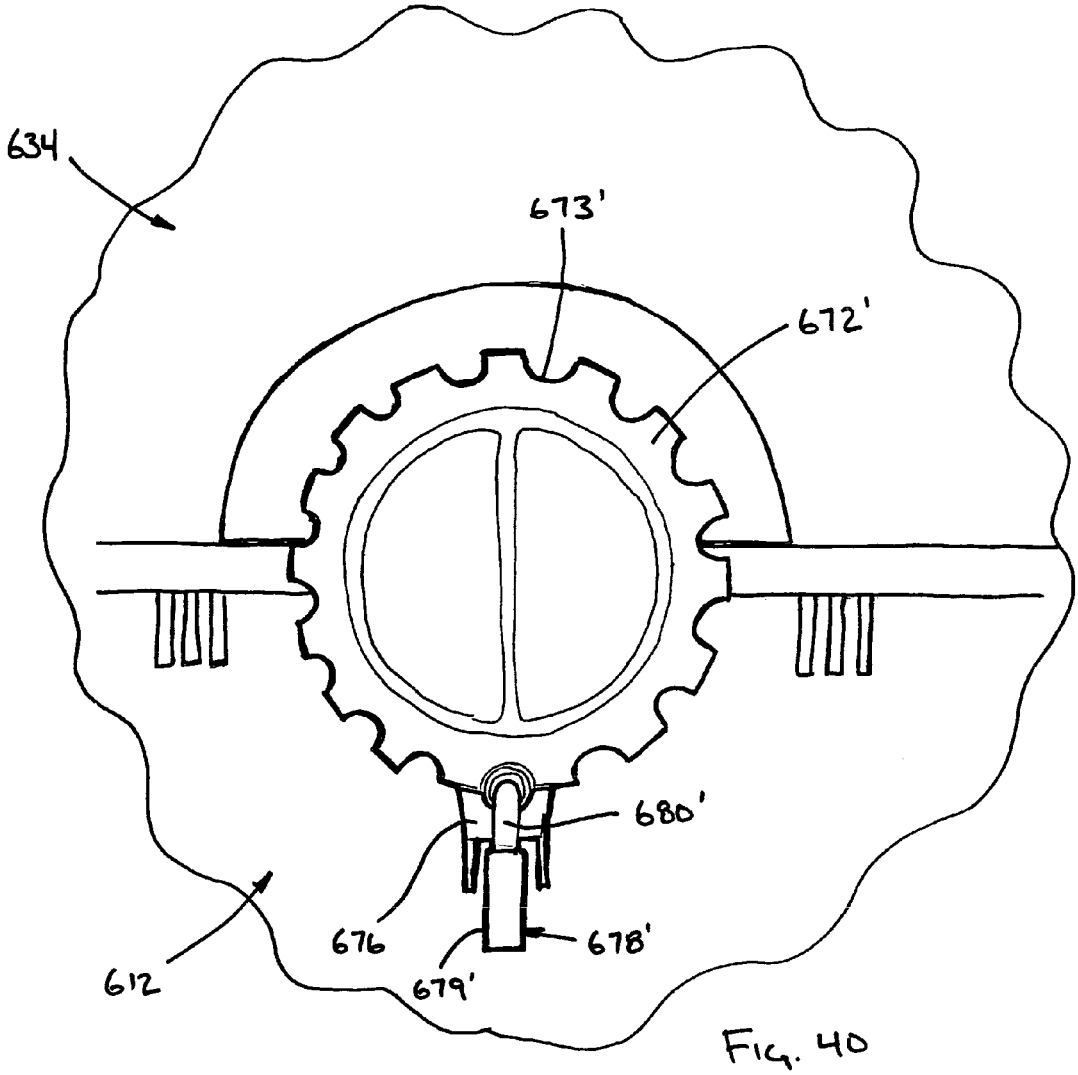
FIG. 40 is a front view of the alternative locking device in accordance with the present invention.

FIGS. 38–40 illustrate an alternative embodiment of the locking device of the present invention, generally designated by the reference numeral 670'. The locking device 670' includes an internally screw-threaded locking dial 672' complementary to the threaded protrusion 673 of the base housing 612, an internally threaded locking dial 672', and a small padlock 778'. The locking dial 672' has a plurality of a plurality of angularly spaced semi-cylindrical depressions 673'. The padlock 778' is substantially conventional padlock well known in the art, including a body 679' and a shackle 680' having two parallel and straight legs connected at one end through a curved bight portion. The base housing 612 of the portable carrier 610 further includes a substantially U-shaped support bracket 676' formed integrally therewith and adapted to support the padlock 778' on the base housing 612. The support bracket 676' is provided with a substantially semi-circular groove adapted to receive the curved bight portion of the shackle 680'. The support bracket 676' is positioned so that when the padlock 778' is mounted to the support bracket 676', the curved bight portion of the shackle 680' partially extends into the semi-cylindrical depressions 673' in the locking dial 672', thus preventing the locking dial 672' from turning and removing it from the threaded protrusion 673 of the base housing 612. Those skilled in the art would understand that without removing the locking dial 672' the rigid cover member 634 cannot be detached from the base housing 612.

It will be appreciated that the locking device 670' with minor modifications may be employed with all the embodiments of the present invention.

Therefore, the portable carrier in accordance with the present invention represents a novel arrangement of the portable article carriers for conveniently and safely storing and transporting various objects, such as household chemical cleaners and other cleaning supplies.

The foregoing description of the preferred embodiments of the present invention has been presented for the purpose of illustration in accordance with the provisions of the Patent Statutes. It is not intended to be exhaustive or to limit the invention to the precise forms disclosed. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. This application is therefore intended to cover any variations, uses, or adaptations of the invention using its general principles. Further, this application is intended to cover such departures from the present disclosure as come within known or customary practice in the art to which this invention pertains. Thus, changes can be made in the above-described invention without departing from the intent and scope thereof. It is also intended that the scope of the present invention be defined by the claims appended thereto.

What is claimed is:

1. A portable carrier comprising:

a rigid base housing defining an internal cavity with a bottom wall and an enclosing wall extending substantially upwardly from said bottom wall, said base housing having an open top defined by a top edge of said enclosing wall; and a cover member dimensioned to closely conform to an outer peripheral surface of said base housing, said portable carrier being reconfigurable between a first position preventing access to said internal cavity and a second position providing access to said internal cavity;

wherein in said second position said cover member is nested under said base housing covering said outer peripheral surface thereof, and wherein said cover member is a reversible flexible cover attached to said base housing, said cover having at least one selectively openable closure member for permitting the selective reconfiguring of said portable carrier between said first position and said second position, and wherein in said second position said reversible flexible cover is reversed and folded over and around said outer peripheral surface of said rigid base housing for nesting under said base housing.

2. The portable carrier as defined in claim 1, further comprising at least one handle member attached to said rigid base housing and provided for carrying said portable carrier by hand.

3. The portable carrier as defined in claim 1, further including a locking device provided for preventing said cover member from being reconfigured; said locking device lockable in both said first and second positions of said cover member.

4. The portable carrier as defined in claim 3, wherein said locking device is a keyless locking device.

5. The portable carrier as defined in claim 3, wherein said locking device is a padlock.

6. The portable carrier as defined in claim 1, wherein said cover member is made of a material resistant to harmful cleaning chemicals.

7. The portable carrier as defined in claim 1, wherein said cover member includes a layer vapor repellant or vapor absorbing material adapted to keep spills or vapors of contents disposed in said portable carrier from passing through said flexible cover.

8. The portable carrier as defined in claim 1, wherein said rigid base housing is substantially rectangular in cross-section.

9. The portable carrier as defined in claim 1, wherein said rigid base housing is substantially circular in cross-section.

10. A portable carrier comprising:

a rigid base housing defining an internal cavity with a bottom wall and an enclosing wall extending substantially upwardly from said bottom wall, said base housing having an open top defined by a top edge of said enclosing wall; and a reversible flexible cover member secured to said base housing and dimensioned to closely conform to said base housing, said cover member having at least one selectively openable closure member for permitting the selective reconfiguring of said portable carrier between a first position preventing access to said internal cavity and a second position providing access to said internal cavity;

wherein in said second position said reversible flexible cover member is reversed and folded over and around an outer peripheral surface of said rigid base housing for nesting under said base housing.

11. The portable carrier as defined in claim 10, further comprising at least one handle member attached to said rigid base housing and provided for carrying said portable carrier by hand.

12. The portable carrier as defined in claim 11, wherein said at least one handle member extending from said flexible cover member through at least one opening therein to accommodate said at least one handle.

13. The portable carrier as defined in claim 11, wherein said at least one handle member has a support portion fixed to said base housing of said carrier and a handle portion provided at a distal end of said handle member, said handle portion extending from said flexible cover member so as to be disposed outside said flexible cover member.

14. The portable carrier as defined in claim 13, wherein said support portion of said at least one handle member is fixed to said bottom wall of said base housing of said carrier.

15. The portable carrier as defined in claim 13, wherein said support portion of said at least one handle member is formed integrally with said rigid base housing.

16. The portable carrier as defined in claim 13, wherein said handle portion includes a grip handle rotatable relative to said base housing that allows said portable carrier to be oriented substantially vertically while transported regardless of the angle of a user's hand relative thereto.

17. The portable carrier as defined in claim 16, wherein said grip handle is positioned offset from a center line of said base housing.

18. The portable carrier as defined in claim 10, wherein said at least one closure member includes a reversible zipper.

19. The portable carrier as defined in claim 18, wherein said zipper extends along approximately three quarters of a circumference of said top edge of said rigid base housing.

20. The portable carrier as defined in claim 19, wherein said zipper extends substantially parallel to said top edge of said rigid base housing.

21. The portable carrier as defined in claim 18, further including a locking device provided for preventing said zipper from being open.

22. The portable carrier as defined in claim 21, wherein said zipper is operated by a slider and a finger tab coupled thereto for pulling said slider to open or close said zipper, said finger tab is coupled to a locking key provided to be locked in said locking device.

23. The portable carrier as defined in claim 10, including two closure members each provided with a reversible zipper.

24. The portable carrier as defined in claim 23, wherein each of said zipper extends substantially parallel to said handle portion and to each other between opposite lateral sides of said rigid base housing.

25. The portable carrier as defined in claim 10, wherein said at least one closure member extends adjacent and substantially parallel to said top edge of said enclosing wall of said rigid base.

26. The portable carrier as defined in claim 10, wherein said flexible cover member is non-removably secured to said rigid base housing.

27. The portable carrier as defined in claim 10, wherein said flexible cover member is removably secured to said rigid base housing.

28. The portable carrier as defined in claim 10, wherein said flexible cover member is provided with at least one side pocket attached to an inside of said flexible cover member so that when said portable carrier is in said second position said at least one side pocket is accessible by a user.

29. The portable carrier as defined in claim 10, wherein said flexible cover member is provided with reinforcing rods provided to keep a shape of said flexible cover member.

30. The portable carrier as defined in claim 10; wherein said flexible cover member includes a paper towel dispensing device provided for dispensing paper towels from a roll of said paper towels disposed within said internal cavity in said portable carrier when said portable carrier is in said first position.

31. The portable carrier as defined in claim 10, wherein said flexible cover member is provided with at least one reversible window formed in said cover member for allowing visual access into contents of said internal cavity of said portable carrier.

32. The portable carrier as defined in claim 10, wherein said flexible cover member is provided with at least one transparent pocket formed in said cover member for inserting a card displaying one of a name of a user and a content of said portable carrier.

33. The portable carrier as defined in claim 10, further including a vapor barrier adapted to prevent spills and vapors of harmful cleaning chemicals disposed in said portable carrier from escaping thereof when said flexible cover member is in said first position, said vapor barrier is attached to one of said base housing and said flexible cover member.

34. The portable carrier as defined in claim 10, wherein said flexible cover member is made of a water-resistant material.

35. The portable carrier as defined in claim 10, further including a locking device provided for preventing said closure member from being reconfigured.

36. The portable carrier as defined in claim 35, wherein said at least one closure member includes an operating device for selectively closing said closure member, said operating device is provided to be immobilized by said locking device.

37. The portable carrier as defined in claim 10, wherein said at least one closure member includes an adjustable aperture defined by an inner edge portion of said flexible cover, said at least one closure member further including a drawstring to gather said inner edge portion of said flexible cover together to close said aperture.

38. The portable carrier as defined in claim 10, further comprising a first handle member attached to said flexible cover for carrying said portable carrier by hand in said first position, and a second handle member attached to said rigid base housing and provided for carrying said portable carrier by hand in said second position, wherein both said first and second handle members are made of substantially flexible materials.

39. The portable carrier as defined in claim 10, wherein said internal cavity includes a substantially cylindrical compartment adapted to receive a roll of paper towels.

40. The portable carrier as defined in claim 10, wherein said internal cavity of said base housing is partitioned to a plurality of storage compartments.

41. The portable carrier as defined in claim 10, further including at least one auxiliary insert tray removably supported within said internal cavity of said rigid base housing.

42. A method for reconfiguring a portable carrier from a storage position to an operating position, said portable carrier including a rigid base housing defining an internal cavity and a reversible flexible cover member secured to said base housing for covering said internal cavity in said storage position and dimensioned to closely conform to said base housing, said cover member having at least one selectively openable closure member, said method comprising the steps of:

opening said closure member;

reversing said flexible cover member by folding said flexible cover member over and around an outer peripheral surface of said rigid base housing for nesting said flexible cover member under said base housing so as to reconfigure said portable carrier into said operating position; and closing said closure member to secure the flexible cover member in the position resulting from said reversing step.

* * * * *